US008548345B2

(12) United States Patent
Minbe et al.

(10) Patent No.: US 8,548,345 B2
(45) Date of Patent: Oct. 1, 2013

(54) IMAGE FORMING APPARATUS WITH TRANSFER NIP ADJUSTMENT FUNCTION

(71) Applicants: Ryuichi Minbe, Ebina (JP); Katsuya Kawagoe, Kawasaki (JP); Kenji Sengoku, Kawasaki (JP); Junpei Fujita, Sagamihara (JP); Osamu Ichihashi, Sagamihara (JP)

(72) Inventors: Ryuichi Minbe, Ebina (JP); Katsuya Kawagoe, Kawasaki (JP); Kenji Sengoku, Kawasaki (JP); Junpei Fujita, Sagamihara (JP); Osamu Ichihashi, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/861,110

(22) Filed: Apr. 11, 2013

(65) Prior Publication Data

US 2013/0223901 A1 Aug. 29, 2013

Related U.S. Application Data

(62) Division of application No. 12/628,649, filed on Dec. 1, 2009, now Pat. No. 8,433,221.

(30) Foreign Application Priority Data

Dec. 4, 2008 (JP) ..... 2008-309357
Feb. 12, 2009 (JP) ..... 2009-030032

(51) Int. Cl.
*G03G 15/16* (2006.01)

(52) U.S. Cl.
USPC ..... 399/66; 399/297; 399/302; 399/303; 399/308; 399/312; 399/121

(58) Field of Classification Search
USPC ..... 399/121, 297, 302, 303, 308, 312, 399/66
See application file for complete search history.

(56) References Cited

U.S. PATENT DOCUMENTS

| | | | | |
|---|---|---|---|---|
| 6,697,595 | B2 | 2/2004 | Kawagoe et al. | |
| 6,731,890 | B1 * | 5/2004 | Rakov et al. | 399/66 |
| 6,766,125 | B1 * | 7/2004 | Izumi | 399/66 |
| 6,795,669 | B2 | 9/2004 | Yamauchi et al. | |
| 6,901,234 | B2 | 5/2005 | Ogiyama et al. | |
| 7,233,761 | B2 | 6/2007 | Kawagoe | |
| 7,346,287 | B2 | 3/2008 | Ogiyama et al. | |
| 7,502,583 | B2 | 3/2009 | Sawai et al. | |
| 2007/0269230 | A1 | 11/2007 | Hoshino et al. | |
| 2009/0116860 | A1 | 5/2009 | Hoshino et al. | |

FOREIGN PATENT DOCUMENTS

| | | |
|---|---|---|
| JP | 63-311369 | 12/1988 |
| JP | 4-242276 | 8/1992 |
| JP | 06-332303 | 12/1994 |

(Continued)

*Primary Examiner* — Ryan Walsh
(74) *Attorney, Agent, or Firm* — Oblon, Spivak, McClelland, Maier & Neustadt, L.L.P.

(57) ABSTRACT

A secondary transfer facing roller includes a roller part that has a through-hole penetrating in a rotary shaft line direction at a rotation center position, and a penetrating shaft member penetrating the through-hole of the roller part and spinning the roller part on a surface of the penetrating shaft member. Eccentric cams are fixed to both end regions that are not located in the roller part, so as to rotate integrally with the penetrating shaft member. A position regulating cam and an abutting roller form a gap between the intermediate transfer belt and the secondary transfer roller immediately before a transfer sheet enters a transfer nip part. While the gap is formed, current flows between the intermediate transfer belt and the secondary transfer roller via the position regulating cam and the abutting roller.

11 Claims, 14 Drawing Sheets

(56) References Cited

FOREIGN PATENT DOCUMENTS

| | | |
|---|---|---|
| JP | 10-83124 | 3/1998 |
| JP | 3822266 | 6/2006 |
| JP | 3911941 | 2/2007 |
| JP | 2007-334292 | 12/2007 |
| JP | 2008-070818 | 3/2008 |
| JP | 2009-58896 | 3/2009 |

* cited by examiner

IMAGE FORMING APPARATUS WITH TRANSFER NIP ADJUSTMENT FUNCTION

CROSS REFERENCE

This application is a division of and is based upon and claims the benefit of priority under 35 U.S.C. §120 for U.S. Ser. No. 12/628,649, filed Dec. 1, 2009, the entire contents of which are incorporated herein by reference. U.S. Ser. No. 12/628,649 claims the benefit of priority under 35 U.S.C. §119 from Japanese Patent Application No. 2008-309357, filed Dec. 4, 2008, and Japanese Patent Application No. 2009-030032, filed Feb. 12, 2009.

BACKGROUND OF THE INVENTION

1. Field of the Invention

The present invention relates to an image forming apparatus, such as a copying machine, a facsimile device and a printer, which sends a recording sheet as a recording body to a transfer nip part of a transfer region formed by an image carrier and a facing member that faces a surface of the image carrier, and then records on this recording sheet a toner image formed on the image carrier. The present invention particularly relates to an image forming apparatus, such as a copying machine, a facsimile device and a printer, which not only has a function for adjusting the pressure of a transfer nip formed by the contact between the image carrier and the facing member by appropriately adjusting a relative distance between the image carrier and the facing member, but also is capable of preventing the occurrence of image degradation, such as displacement of the position of an image, which is caused by load fluctuations of the image carrier generated when the recording sheet enters and is removed from the transfer nip.

2. Description of the Related Art

This type of image forming apparatus can not only adjust the pressure of the transfer nip formed by the contact between the image carrier and the facing member by adjusting the relative distance therebetween, but also alleviate load fluctuations of the image carrier caused when the recording sheet enters the transfer nip, the recording sheet formed from cardboard as a recording body. As distance adjusting means for adjusting the relative distance between the image carrier and the facing member, generally the one having a configuration for pushing back the facing member to a certain level against a biasing force, while biasing the facing member toward the image carrier by using biasing means.

For example, the distance adjusting means of the image forming apparatus described in Japanese Patent Application Laid-open No. H10-83124 has such configuration. Specifically, a transfer roller of this image forming apparatus that functions as the facing means has a cylindrical roller part and a shaft member protrudes from each end face of the roller part so as to rotate integrally with the roller part. The protruding parts of the shaft member are provided with eccentric cams so that the shaft member can spin. A motor for spinning the eccentric cams on a circumferential surface of the shaft member is directly connected to the eccentric cams. In the eccentric cams that are spun on the circumferential surface of the shaft member by the motor, cam surfaces are caused to abut with an end part of a photosensitive drum in a shaft line direction within a range of predetermined rotation angles. The transfer roller that is biased toward the photosensitive drum is moved against the biasing force away from the photosensitive drum by means of this abutment, whereby the inter-shaft distance between the photosensitive drum and the transfer roller.

However, in this conventional image forming apparatus, a drive transmission mechanism has to be provided in the vicinity of each end of a roller shaft line direction, in order to drive the eccentric cam spinning on the shaft member on the one end side of the transfer roller in the shaft line direction and the eccentric cam spinning on the shaft member on the other end side. Such layout restriction causes significant downsizing of the apparatus.

Note in this conventional image forming apparatus that the eccentric cams spinning on the shaft member of the transfer roller are caused to abut with the photosensitive drum. The same problem occurs in a configuration where the eccentric cams spinning on the shaft member of the photosensitive drum are caused to abut with the transfer roller to move the transfer roller away from the photosensitive drum. The same problem occurs also in a configuration where a belt member for endlessly moving at least either the photosensitive drum and the facing member while wrapping a rotatable support rotating body, the photosensitive drum and the facing member being brought into contact with each other to form the transfer nip.

When, on the other hand, a tip end of the recording body enters the transfer nip formed by the image carrier and a contact member, or when a rear end of the recording body is removed from the transfer nip, instantaneous load fluctuations occur in the image carrier, disturbing the surface movement speed of the image carrier. As a result, so-called shock jitter occurs, which is image degradation caused by displacement of the position of an image. Such image degradation occurs easily if the basis weight of the recording body is as great as that of cardboard.

For example, Japanese Patent Application Laid-open No. 2007-334292 describes an image forming apparatus that has gap forming means for separating an image carrier and a contact member to form a gap therebetween at predetermined timing immediately before a tip end of a recording body enters the position of a transfer nip where the image carrier and the contact member contact with each other, or immediately before a rear end of the recording body is removed from the position of the transfer nip. In this apparatus, formation of the gap between the image carrier and the contact member at the timing immediately before the entry of the tip end of the recording body or immediately before the separation of the rear end of the recording body can reduce the load fluctuations that occur in the image carrier at the time of the entry or separation of the recording medium.

Furthermore, in an apparatus that performs transfer using a transfer electric field formed by the transfer nip described above, the transfer electric field is formed by starting to apply transfer voltage to the image carrier or the contact member before the entry of the tip end of the recording medium into the transfer nip, by using transfer voltage application means. When the transfer voltage application means starts applying the transfer voltage after the tip end of the recording body enters the transfer nip, the output of the transfer voltage application means does not increase before transfer of an image tip end part starts, and consequently a sufficient transfer electric might not be obtained at the image tip end part. This is because, in this case, image degradation called a tip end part transfer failure occurs.

However, when the transfer voltage is applied before the tip end of the recording body enters the transfer nip in order to prevent the occurrence of the tip end part transfer failure, this conventional apparatus causes adverse effects in which leak discharge occurs at the gap between the image carrier and the contact member that is formed immediately before the entry into the transfer nip, damaging the image carrier.

Technologies relating to the present invention are (also) disclosed in, e.g., Japanese Patent Application Laid-open No. H4-242276, Japanese Patent No. 3,822,266, and Japanese Patent No. 3,911,941.

SUMMARY OF THE INVENTION

A first object of the present invention is to provide an image forming apparatus that is capable of improving the degree of freedom of a layout of distance adjusting means for adjusting the distance between an image carrier and an opposing member of a transfer region.

A second object of the present invention is to provide an image forming apparatus that is capable of preventing the occurrence of image degradation without damaging the image carrier, the image degradation being caused by displacement of an image that is caused when a recording sheet serving as a recording body enters or is removed from a transfer nip.

According to an aspect of the present invention, in an image forming apparatus, at least either an image carrier or a facing member that faces the image carrier and forms a transfer region is configured by a belt member supported by a support rotating body or a rotating body. A distance between the image carrier and the facing member in the transfer region is adjusted by changing a rotation position of cams provided to a shaft part of the support rotating body or the rotating body. In the transfer region, a visible image on the image carrier is transferred to the facing member or to a recording sheet passed through between the image carrier and the facing member. The support rotating body or the rotating body provided with the cams at the shaft part thereof is configured by at least a main body part that has a through-hole penetrating in a rotary shaft line direction at a rotation center position, and a penetrating shaft member that serves as the shaft part penetrating the through-hole of the main body part and spinning the main body part on a surface of the penetrating shaft member. Out of the entire region in a longitudinal direction of the penetrating shaft member, the cams are fixed to both end regions that are not located in the main body part, such that the cams are rotated integrally with the penetrating shaft member.

According to another aspect of then present invention, an image forming apparatus comprises an image carrier that carries a toner image and performs surface movement; a contact member that comes into contact with the image carrier while performing surface movement and forms a transfer nip; a recording body sending device for sending a recording body toward the transfer nip; a transfer voltage application device for starting to apply transfer voltage to the image carrier or the contact member prior to the entry of the recording body into the transfer nip, so as to form a transfer electric field for transferring the toner image on the image carrier to the recording body; and a gap forming device for separating the image carrier and the contact member from each other to form a gap therebetween immediately before the recording body enters the transfer nip part. The image forming apparatus further comprises a conducting device for conducting electricity so that current induced by the transfer voltage applied by the transfer voltage application device flows between the image carrier and the contact member while the gap forming device separates the image carrier and the contact member from each other to form a gap therebetween.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENT(S)

Figure 1:
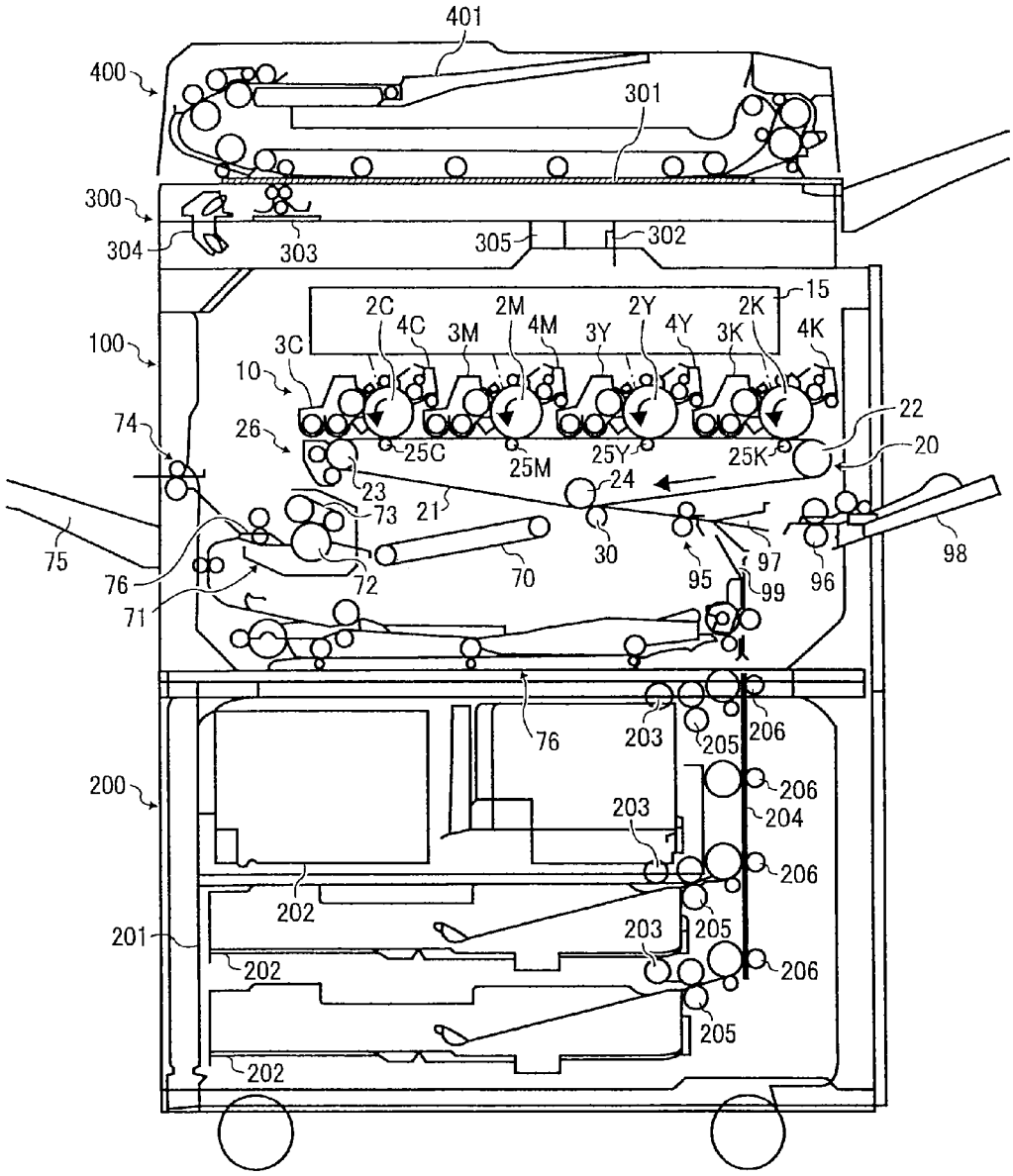
FIG. 1 is a diagram showing a schematic configuration of a copying machine according to a first embodiment of the present invention.

Preferred embodiments of the present invention will be described hereinafter. It is to be noted the reference numerals used in each embodiment are independent of the reference numerals of the other embodiment, i.e., the same reference numerals do not always designate the same structural elements.

1st Embodiment

The first embodiment accomplishes mainly the first object described above.

Hereinafter, the first embodiment is described in which the present invention is applied to a tandem-type color copying machine (called simply as "copying machine" hereinafter) functioning as an image forming apparatus.

FIG. 1 shows a schematic configuration of a copying machine according to the first embodiment. This copying machine has a printer part 100, a sheet feeding part 200, a scanner part 300 attached onto the printer part 100, and an automatic document feeder (ADF) 400 attached onto the scanner part 300.

The printer part 100 an endless belt-type intermediate transfer belt 21 functioning as an image carrier. The intermediate transfer belt 21 is wrapped around a driving roller 22, a driven roller 23 and a secondary transfer facing roller 24, such that the side view of the intermediate transfer belt 21 forms an inverted triangle. The intermediate transfer belt 21 is endlessly moved clockwise in the diagram by rotational drive of the driving roller 22. Four image forming units 1C, M, Y and K for forming cyan (C), magenta (M), yellow (Y) and black (K) toner images are arranged in an upper part of the intermediate transfer belt 21 along a belt movement direction.

The image forming units 1C, M, Y and K have, respectively, photosensitive drums 2C, M, Y and K, developing units 3C, M, Y and K, and photosensitive drum cleaning devices 4C, M, Y and K. The photosensitive drums 2C, M, Y and K each are brought into contact with the intermediate transfer belt 21 to form C, M, Y and K primary transfer nips, and at the same time rotated and driven counterclockwise in the diagram by driving means that is not shown. Note that the developing units 3C, M, Y and K use C, M, Y and K toners to develop electrostatic latent images formed on the photosensitive drum 2C, M, Y and K. Furthermore, the photosensitive drum cleaning devices 4C, M, Y and K clean transfer residual toner on the photosensitive drums 2C, M, Y and K that have passed the primary transfer nip. In this printer, a tandem image forming part 10 is configured by the four image forming units 1C, M, Y and K arranged along the belt movement direction.

An optical writing unit 15 is disposed in an upper part of the tandem image forming part 10 within the printer part 100. This optical writing unit 15 performs optical scanning and thereby an optical writing process on the surfaces of the photosensitive drums 2C, M, Y and K that are rotated and driven counterclockwise in the diagram. Prior to the optical writing process, the surfaces of the photosensitive drums 2C, M, Y and K are uniformly charged by uniform charging means of each of the image forming units 1C, M, Y and K.

A transfer unit 20 having the intermediate transfer belt 21 and the like has primary transfer rollers 25C, M, Y and K within the loop of the intermediate transfer belt 21. These primary transfer rollers 25C, M, Y and K presses the intermediate transfer belt 21 against the photosensitive drums 2C, M, Y and K by means of the back of the C, M, Y and K primary transfer nips.

A secondary transfer roller 30 is disposed in a lower part of the intermediate transfer belt 21. This secondary transfer roller 30 forms a secondary transfer nip by coming into contact from the front face of the intermediate transfer belt 21 onto the section where the intermediate transfer belt 21 is wrapped around the secondary transfer facing roller 24. A recording sheet is sent to this secondary transfer nip at predetermined timing. Then, the toner images with the four superimposed colors are secondarily transferred at once onto the intermediate transfer belt 21 at this secondary transfer nip.

The scanner part 300 uses a reading sensor 302 to read image information of a document placed on a contact glass 301, and sends the read image information to a controller of the printer part 100. The controller, not shown, controls a laser diode, LED, or other light source of the optical writing unit 15 of the printer part 100 based on the image information received from the scanner part 300, emits C, M, Y and K laser writing light beams, and optically scans the photosensitive drums 2C, M, Y and K. Through this optical scanning, electrostatic latent images are formed on the surfaces of the photosensitive drums 2C, M, Y and K, and these latent images are developed to the C, M, Y and K toner images through a predetermined developing process.

The sheet feeding part 200 has sheet feeding cassettes 202 disposed in multiple stages within a paper bank 201, sheet feeding rollers 203 for sending out recording sheets from the sheet feeding cassettes 202, a separation roller 205 for separating the sent recording sheets and guiding the separated recording sheet to a sheet feeding path 204, and a conveying roller 206 for conveying the recording sheet to a sheet feeding path 99 of the printer part 100.

When feeding sheets, the sheets can be fed manually instead of using the sheet feeding part 200, and therefore a manual tray 98 for manual feeding, and a separation roller 96 for separating the recording sheets on the manual tray 98 one by one and sending the separated recording sheet toward a manual sheet feeding path 97 are also provided. The manual sheet feeding path 97 merges into the sheet feeding path 99 in the printer part 100.

A resist roller pair 95 is disposed in the vicinity of the foot of the sheet feeding path 99. The resist roller pair 95 holds, between the rollers, a recording sheet fed through the sheet feeding path 99 and then sends the recording sheet toward the secondary transfer nip at predetermined timing.

When copying a color image using the copying machine according to this embodiment, a document is set on a document table 401 of the ADF 400 or on the contact glass 301 of the scanner part 300 by opening the ADF 400, and the document is pressed by closing the ADF 400. Then, a start switch, which is not shown, is pushed. When the document is set in the ADF 400, the document is fed onto the contact glass 301. Thereafter, the scanner part 300 is driven, and a first traveling body 303 and a second traveling body 304 start traveling along the surface of the document. A light beam emitted from the light source of the first traveling body 303 is projected on the surface of the document, and thus obtained reflected light is folded toward the second traveling body 304. The folded light is further folded by a mirror of the second traveling body 304 and enters the reading sensor 302 through an imaging lens 305. In this manner, the contents of the document are read.

Once receiving the image information from the scanner part 300, the printer part 100 feeds recording sheets of the size corresponding to the image information to the sheet feeding path 99. In response to this, the driving roller 22 is rotated and driven by an unshown driving motor to endlessly move the intermediate transfer belt 21 clockwise in the diagram. At the same time, rotation drive of the photosensitive drums 2C, M, Y and K of the image forming units 1C, M, Y and K are started, and thereafter the uniform charging process, optical writing process, and developing process are carried out on the photosensitive drums 2C, M, Y and K. The C, M, Y and K toner images that are formed on the surfaces of the photosensitive drums 2C, M, Y and K by these processes are sequentially superimposed at the C, M, Y and K primary transfer nips and primarily transferred onto the intermediate transfer belt 21, whereby a four-color superimposed toner image is formed.

In the sheet feeding part 200, one of the sheet feeding rollers 203 is selectively rotated in accordance with the size of the recording sheets, and the recording sheets are sent out from one of the three sheet feeding cassettes 202. The sent recording sheets are separated one by one by the separation roller 205 and guided to the sheet feeding 206. Thereafter, the separated recording sheet is sent to the sheet feeding path 99 within the printer part 100 via the conveying roller 206. When using the manual tray 98, the sheet feeding roller on the tray is rotated and driven, whereby the recording sheets on the tray are sent to the manual sheet feeding path 97 while being separated by the separation roller 96, and reach the vicinity of the foot of the sheet feeding path 99. In the vicinity of the sheet feeding path 99, the separated recording sheet hits the resist roller pair 95 at the tip end thereof and then stops. Subsequently, when the resist roller pair 95 is rotated and driven in synchronization with the four-color superimposed toner image on the intermediate transfer belt 21, the recording sheet is sent into the secondary transfer nip and contacts the four-color superimposed toner image on the belt. Consequently, the four-color superimposed toner image is secondarily transferred onto the recording sheet at once by the effects of nip pressure, a transfer electric field, and the like.

The recording sheet to which the four-color superimposed toner image is secondarily transferred at the secondary transfer nip is sent into a fixing device 71 by a sheet conveying belt 70. Then, when the recording sheet is held at a fixing nip between a pressure roller 72 and a fixing belt 73 in the fixing device 71, the four-color superimposed toner image is fixed to the surface by the application of pressure or heat. In this manner, the recording sheet having a color image formed thereon is stacked on a catch tray 75 outside the apparatus via a discharge roller pair 74. Note that when forming the image on the other side of the recording sheet, the recording sheet is discharged from the fixing device 71 and then sent to a sheet inverting device 75 by switching the passage using a switching click 76. After being inverted, the recording sheet is returned to the resist roller pair 95 and passes through the secondary transfer nip and the fixing device 71 again.

A belt cleaning device 26 contacts the surface of the intermediate transfer belt 21 after the recording sheet passes through the secondary transfer nip and before the recording sheet enters the C primary transfer nip, which is the furthest upstream for carrying out a primary transfer step out of the four colors. This belt cleaning device 26 cleans transfer residual toner on the belt surface.

Figure 2:
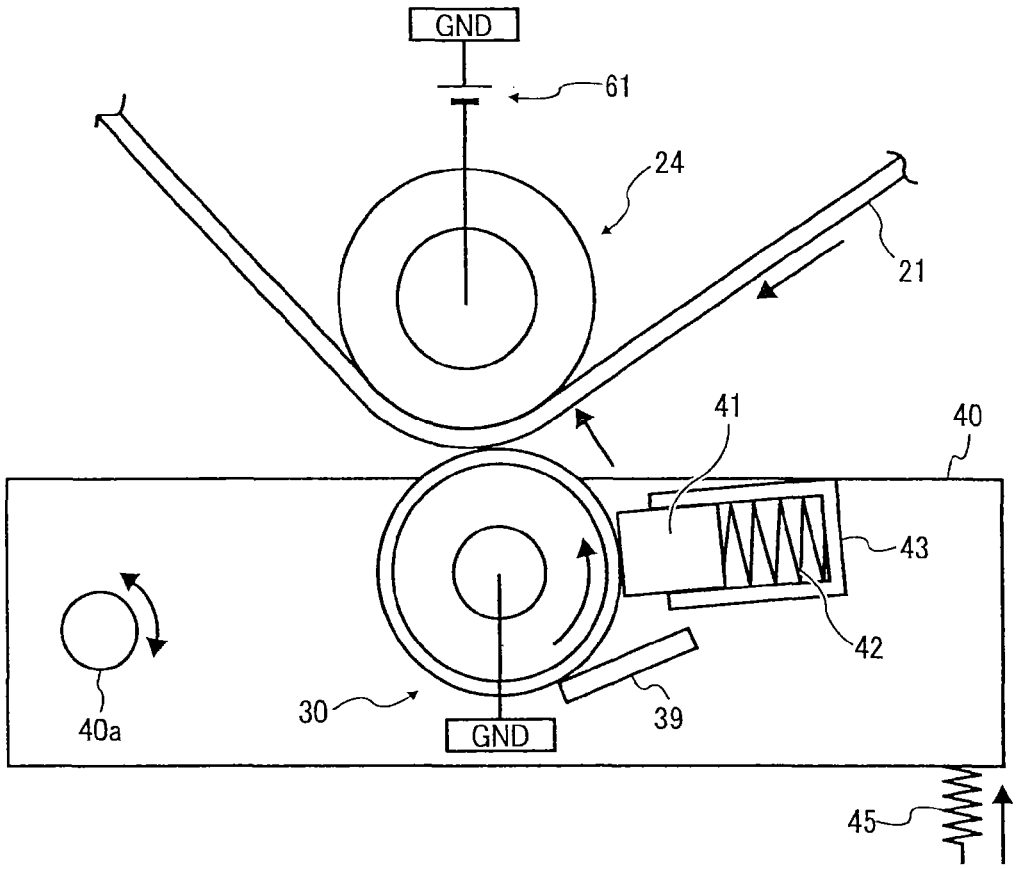
FIG. 2 is an enlarged schematic diagram showing a secondary transfer nip and a peripheral configuration thereof within a printer part of the copying machine.

FIG. 2 shows the secondary transfer nip and a peripheral configuration thereof within the printer part 100 of the copying machine according to this embodiment. In this diagram, the secondary transfer facing roller 24, circumferential surface of which is partially wrapped with the intermediate transfer belt 21 within the loop thereof, serves to support the intermediate transfer belt 21 by means of the circumferential surface, to keep its shape so as to correspond to a constant curvature. In the section where the intermediate transfer belt 21 is wrapped around the secondary transfer facing roller 24, the secondary transfer roller 30 contacts the surface of the belt, forming the secondary transfer nip.

The secondary transfer roller 30 is rotatably held by a roller unit holding body 40 via a bearing that is not shown. The roller unit holding body 40 is configured so as to be able to rotate around a rotary shaft 40*a* disposed parallel to a rotary shaft line of the secondary transfer roller 30. When the roller unit holding body 40 is rotated counterclockwise around the rotary shaft 40*a*, the secondary transfer roller 30 held by the roller unit holding body 40 is pressed against the intermediate transfer belt 21, thereby forming the secondary transfer nip. Furthermore, when the roller unit holding body 40 is rotated clockwise around the rotary shaft 40*a*, the secondary transfer roller 30 held by the roller unit holding body 40 separates from the intermediate transfer belt 21. In the copying machine according to this embodiment, an end part opposite to the rotary shaft 40*a* of the roller unit holding body 40 is constantly biased toward the intermediate transfer belt 21 by a biasing coil spring 45. By causing the biasing coil spring 45 to constantly apply force to the roller unit hold body 40 to rotate the roller unit holding body 40 counterclockwise around the rotary shaft 40*a*, the secondary transfer roller 30 is biased toward the intermediate transfer belt 21.

A rotation drive force of an unshown roller driving motor is transmitted to the secondary transfer roller 30 via an unshown gear or other drive transmission means, whereby the secondary transfer roller 30 is rotated and driven counterclockwise. The roller unit holding body 40 is further caused to hold such roller driving motor and drive transmission means so that the roller driving motor and the drive transmission means are rotated along with the secondary transfer roller 30 and the roller unit holding body 40. Moreover, the roller unit holding body 40 is caused to hold a cleaning blade 39, solid lubricant agent 41, lubricant pressing device 43 and the like.

The toner on the belt adheres to the surface of the secondary transfer roller 30 that is in contact with the surface of the intermediate transfer belt 21 carrying the toner image. If the adhered toner is left as it is, the adhered toner is transferred to the back of the recording sheet at the secondary transfer nip, causing so-called backside stain. Therefore, in this copying machine, the edge of the cleaning blade 39 is brought into contact with the surface of the secondary transfer roller 30 to mechanically remove the toner from the surface of the secondary transfer roller 30. In this configuration, because the contact of the cleaning blade 39 generates a load inhibiting the rotation of the secondary transfer roller 30, the secondary transfer roller 30 cannot be driven-rotated by dragged rotation thereof along with the intermediate transfer belt 21. Therefore, the secondary transfer roller 30 is rotated and driven using the abovementioned roller driving motor.

The lubricant pressing device 43 presses the solid lubricant agent 41, which is made of a zinc stearate clump or the like against, against the secondary transfer roller 30 by using the biasing coil spring 42, to apply lubricant powder to the secondary transfer roller 30. By applying the lubricant agent in this manner, the increase of the rotational load caused by the contact between the cleaning blade 39 and the secondary transfer roller 30 is prevented. In addition, the blade edge can be prevented from being seized. Instead of pressing the solid lubricant agent 41 against the secondary transfer roller 30, a rotation application brush for scraping the solid lubricant agent 41 and applying it to the secondary transfer roller 30 may be provided.

Figure 3:
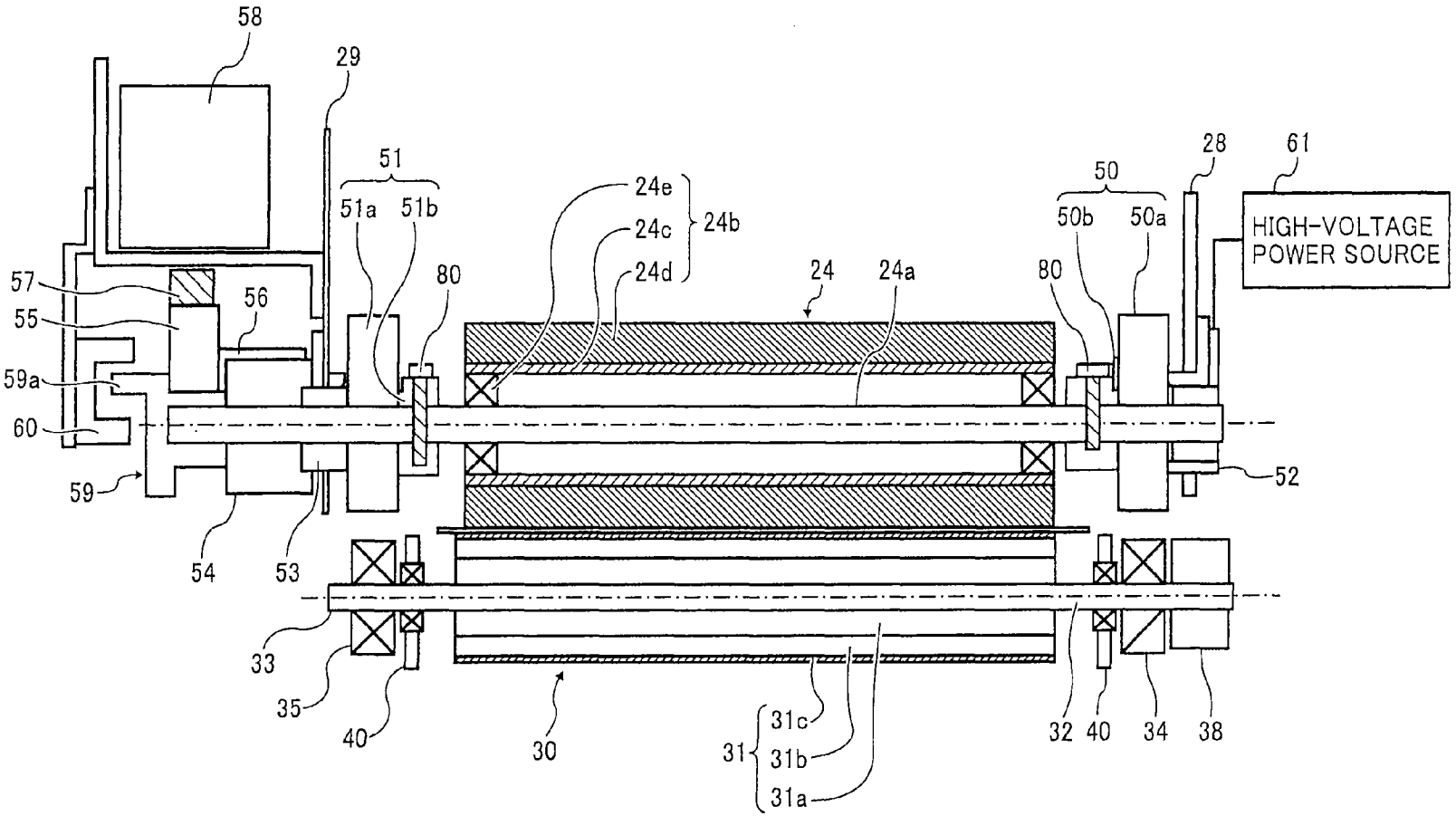
FIG. 3 is an enlarged cross-sectional diagram showing a peripheral configuration of the secondary transfer nip.
Figure 4:
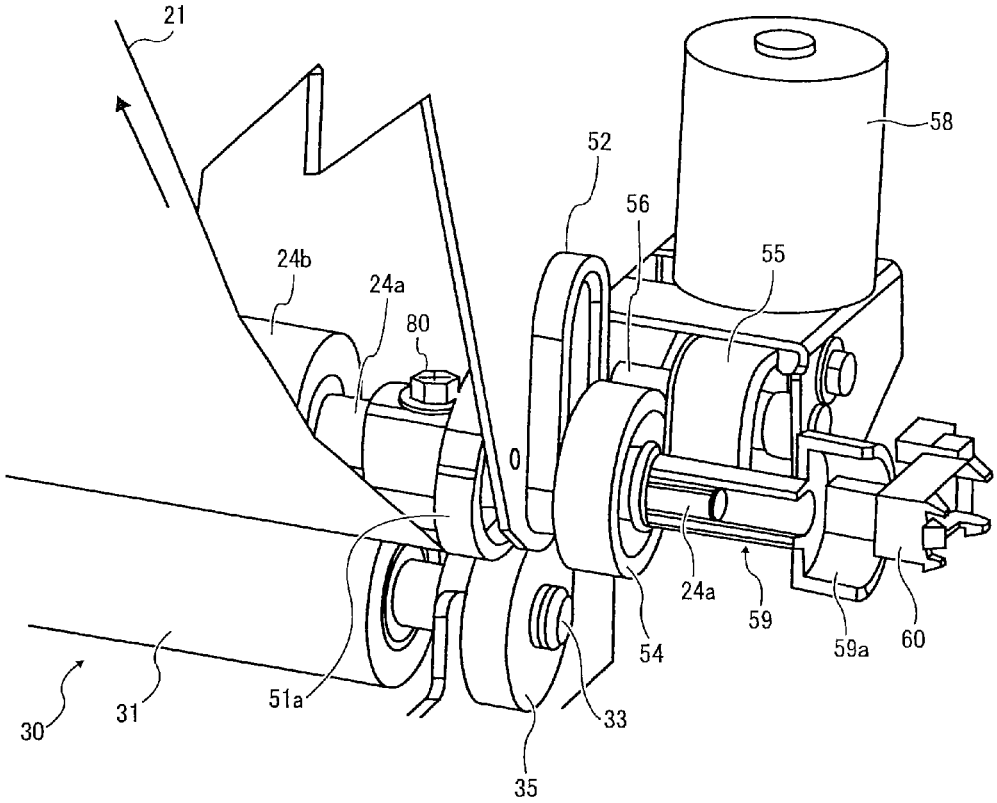
FIG. 4 is a perspective view showing a part of the peripheral configuration.

A characteristic configuration of the copying machine according to this embodiment is described next. FIG. 3 shows a peripheral configuration of the secondary transfer nip, and FIG. 4 also shows a peripheral configuration of the secondary transfer nip.

In these diagrams, the secondary transfer roller 30 has a roller part 31, a first shaft member 32 and second shaft member 33 that protrude from both end faces in a shaft line direction of the roller part 31 and extend in a rotary shaft line direction, and a first spinning roller 34 and second spinning roller 35 described hereinafter. The roller part 31 further has a cylindrical hollow cored bar 31*a*, an elastic layer 31*b* fixed to a circumferential surface of the hollow cored bar 31*a* and made of an elastic material, and a surface layer 31*c* fixed to a circumferential surface of the elastic layer 31*b*.

Examples of the metal configuring the hollow cored bar 31*a* include, but are not limited to, stainless and aluminum. It is desired that the elastic layer 31*b* have a JIS-A hardness of 70 [°] or less. However, because the cleaning blade 39 is brought into contact with the roller part 31, various problems might occur if the elastic layer 31*b* is excessively elastic. Hence, it is desired that the elastic layer 31*b* have a JIS-A hardness of 40 [°] or more. The elastic layer 31*b* having a JIS-A hardness of approximately 50 [°] is formed by means of epichlorohydrin rubber exerting a certain level of electrical conductivity. As the rubber material exerting the electrical conductivity, EPDM or Si rubber having carbon dispersed therein, NBR having an ion electrical conductivity function or urethane rubber may be used in place of the above-mentioned electrically conductive epichlorohydrin rubber. Because most rubber materials exert good chemoaffinity for toners or relatively high friction coefficients, the surface of the rubber elastic layer 31*b* is coated with the surface layer 31*c*. In this manner, adhesion of the toner to the surface of the roller part 31 is prevented, and the frictional load between the blade and the roller part is reduced. For the material of the surface layer 31*c*, it is preferred to use a material in which carbon, ion conducting material, or other resistance adjustment material is contained in a fluorine resin having a low friction coefficient and exerting good toner parting characteristics.

When the secondary transfer roller 30 comes into contact with the intermediate transfer belt 21 and rotates, the secondary transfer roller 30 often has a small linear difference with the belt. The surface layer 31*c* adjusts the friction coefficient to 0.3 or lower, so that the belt does not slip due to the linear speed difference. The intermediate transfer belt 21 needs to be driven at a constant speed in order to transfer each color of image without causing color shifting. Therefore, it is important that the surface frictional resistance of the surface layer 31*c* of the secondary transfer roller 30 is low.

The secondary transfer roller 30 having such a configuration is biased toward the intermediate transfer belt 21 wrapped around the secondary transfer facing roller 24. The secondary transfer facing roller 24 wrapping the intermediate transfer belt 21 has a roller part 24*b*, which is a cylindrical main body part, and a penetrating shaft member 24*a* that penetrates a rotation center section of the roller part 24*b* in the rotary shaft line direction and spins the roller part 24*b* on the surface of the penetrating shaft member 24*a*. The penetrating shaft member 24*a* made from metal freely spins the roller part 24*b* on a circumferential surface of the penetrating shaft member 24*a*. The roller part 24*b* functioning as the main body part has a drum-like hollow cored bar 24*c*, an elastic layer 24*d* fixed to a circumferential surface of the hollow cored bar 24*c* and made of an elastic material, and a ball bearing 24*e* that is press-fitted to each end of the hollow cored bar 24*c* in the shaft line direction. The ball bearing 24*e* rotates on the penetrating shaft member 24*a* along with the hollow cored bar 24*c* while supporting the hollow cored bar 24*c*. The elastic layer 24*d* is press-fitted to an outer circumferential surface of the hollow cored bar 24*c*.

The penetrating shaft member 24*a* is rotatably supported by a first bearing 52 fixed to a first side plate 28 of a transfer unit stretching the intermediate transfer belt 21, and a second ball bearing 53 fixed to a second side plate. However, the penetrating shaft member 24*a* is stopped and not rotated for most of the time required for a print job. The roller part 24*b* that is dragged and rotated as the intermediate transfer belt 21 endlessly moves is freely spun on the circumferential surface of the penetrating shaft member 24*a*.

The elastic layer 24*d* fixed to the circumferential surface of the cored bar 24*c* is configured by an electrically conductive rubber material, a resistance value of which is adjusted by addition of a ion conducting material in order to exert a resistance of at least 7.5 [Log Ω]. The reason that the electric resistance of the elastic layer 24*d* is adjusted to fall within a predetermined range is to prevent transfer current from centering on to a section where the belt and the roller are in direct contact with each other without having a recording sheet therebetween in the secondary transfer nip, the recording sheet having a comparatively small roller shaft line direction, such as an A5-sized recording sheet. By setting the electric resistance of the elastic layer 24*d* at a value greater than the value of the resistance of the recording sheet, the transfer current can be prevented from centering on in such section.

As the electrically conductive rubber material configuring an elastic layer 16*c*, a foamed rubber that exerts an elasticity at an Asker-C hardness of approximately 40 [°]. By configuring the elastic layer 16*c* with such foamed rubber, the elastic layer 16*c* can be deformed flexibly in a thickness direction thereof within the secondary transfer nip, and a secondary transfer nip that is somewhat wide in a sheet conveying direction can be formed. As described above, in this copying machine it is difficult to use a quite elastic material as the material of the roller part of the secondary transfer roller 30, because the cleaning blade 39 needs to be brought into contact with the secondary transfer roller 30. Therefore, in place of the secondary transfer roller 30, the roller part 24*b* of the secondary transfer facing roller 24 is elastically deformed.

Out of the entire region in a longitudinal direction of the penetrating shaft member 24*a* of the secondary transfer facing roller 24, in both end regions that are not located in the roller part 24*b*, eccentric cams serving as members to be abutted with the secondary transfer roller 30 are fixed so as to be rotated integrally with the penetrating shaft member 24*a*. Specifically, a first eccentric cam 50 is fixed in one end part region in the longitudinal direction of the penetrating shaft member 24*a*. The first eccentric cam 50 has an eccentric cam part 50*a* and circle roller part 50*b* integrally formed side by side in a shaft line direction. A screw 80 penetrating the roller part 50*b* is screwed together with the penetrating shaft member 24*a*, whereby the first eccentric cam 50 is fixed to the penetrating shaft member 24*a*. Furthermore, a second eccentric cam 51 with the same configuration as the first eccentric cam 50 is fixed in the other end part region in the longitudinal direction of the penetrating shaft member 24*a*.

A drive receiving gear 54 is fixed in a region outside the second eccentric cam 51 in the shaft line direction of the penetrating shaft member 24*a*. In addition, a detected disk 59 is fixed further outside the drive receiving gear 54.

On the other hand, in the second side plate 29, a cam driving motor 58 is fixed, and an input/output gear unit is rotatably fixed. In this input/output gear unit, an input gear part 55, which is engaged with a motor gear 57 of the cam driving motor 58 and receives a drive force, and an output gear part 56, which is engaged with the abovementioned drive receiving gear 54 fixed to the penetrating shaft member 24*a* and transmits the drive force, are integrally formed side by side in the shaft line direction. The penetrating shaft member 24*a* can be rotated by driving the cam driving motor 58. At this moment, the roller part 24*b* can be freely spun on the penetrating shaft member 24*a* even by rotating the penetrating shaft member 24*a*. Thus, the dragged rotation of the roller part 24*b* with the belt can be prevented.

When the rotation of the penetrating shaft member 24*a* is stopped within a predetermined rotation angle range, cam parts of the first eccentric cam 50 and the second eccentric cam 51 are brought into abutment with the secondary transfer roller 30, and the secondary transfer roller 30 is pushed back against the biasing force of the biasing coil spring (45) of the roller unit holding body. As a result, the inter-shaft distance between the secondary transfer facing roller 24 and the secondary transfer roller 30 is adjusted by moving the secondary transfer roller 30 away from the secondary transfer facing roller 24 (or the intermediate transfer belt 21). Such a configuration has distance adjusting means for adjusting the inter-shaft distance between the secondary transfer facing roller 24 and the secondary transfer roller 30 by means of the first eccentric cam 50, the second eccentric cam 51, the cam driving motor 58, various gears, and the abovementioned roller unit holding body. The secondary transfer facing roller 24 serving as a rotatable support rotating body spins the roller part 24*b* freely on the penetrating shaft member 24*a* penetrating the cylindrical roller part 24*b*. Because the rotation of the penetrating shaft member 24*a* rotates integrally the eccentric cams (50, 51) fixed to the both ends in the shaft line direction of the penetrating shaft member 24*a*, the eccentric cams at the both ends can be rotated by simply providing one end of the shaft line direction with a drive transmission mechanism for transmitting the drive to the penetrating shaft member 24*a*. Therefore, unlike the conventional technology where the drive transmission mechanism has to be provided on each end, the degree of freedom of the layout of the distance adjusting means can be improved.

In this copying machine, while the cored bar 31*a* of the secondary transfer roller 30 is connected to the ground, a secondary transfer bias with the same polarity as the toner is applied to the cored bar 24*c* of the secondary transfer facing roller 24. Consequently, a secondary transfer electric field for electrostatically moving the toner from the secondary transfer facing roller 24 side toward the secondary transfer roller 30 side is formed in the secondary transfer nip between the rollers.

The first bearing 52 that rotatably receives the metallic penetrating shaft member 24*a* of the secondary transfer facing roller 24 is configured by an electrically conductive sliding bearing. This electrically conductive first bearing 52 is connected to a high-voltage power source 61 that outputs a secondary transfer bias. The secondary transfer bias output by the high-voltage power source 61 is guided to the secondary transfer facing roller 24 via the electrically conductive first bearing 52. Then, in the secondary transfer facing roller 24, the secondary transfer bias is transmitted to the metallic penetrating shaft member 24*a*, the metallic ball bearing 24*e*, the metallic cored bar 24*c*, and the electrically conductive elastic layer 24*d*, sequentially.

The detected disk 59 that is fixed to one end of the penetrating shaft member 24*a* has a detected part 59*a* that rises in the shaft line direction at a predetermined position of the penetrating shaft member 24*a* in a rotation direction. On the other hand, an optical sensor 60 is fixed to a motor bracket supporting the cam driving motor 58. When the penetrating shaft member 24*a* comes to a position within the predetermined rotation angle range in the course of the rotation of the penetrating shaft member 24*a*, the detected part 59*a* of the detected disk 59 enters between a light-emitting element and light-receiving element of the optical sensor 60 to block the optical path therebetween. The light-receiving element of the optical sensor 60 receives light from the light-emitting element and transmits a light-receiving signal to the unshown controller. The controller learns the rotation angular positions of the cam parts of the eccentric cams (50, 51) fixed to the penetrating shaft member 24*a*, based on the timing when the light-receiving signal is no longer received from the light-receiving element or the amount of drive of the cam driving motor 58 obtained from this timing.

As described above, the eccentric cams (50, 51) are brought into abutment with the secondary transfer roller 30 within the predetermined rotation angle range, and then the secondary transfer roller 30 is pushed back against the biasing force of the biasing coil spring (45) and moved away from the secondary transfer facing roller 24 (this pushing back is called "push down" hereinafter). The push-down amount here is determined based on the rotation angular positions of the eccentric cams (50, 51). Note that the greater the push-down amount of the secondary transfer roller 30, the wider the inter-shaft distance between the secondary transfer facing roller 24 and the secondary transfer roller 30.

In the secondary transfer roller 30, the first spinning roller 34 is provided so as to be able to spin freely in the first shaft member 32 that rotates integrally with the roller part 31. This first spinning roller 34 has a slightly bigger external diameter than the roller part 31 and has a doughnut-like disk shape. The first spinning roller 34 itself functions as a ball bearing and is capable of spinning on a circumferential surface of the first shaft member 32. The second spinning roller 35 with the same configuration as the first spinning roller 34 is provided to the second shaft member 33 of the secondary transfer roller 30 so as to be able to spin.

As described above, in the secondary transfer facing roller 24, although the eccentric cams (50, 51) fixed to the penetrating shaft member 24*a* are brought into abutment with the secondary transfer roller 30 at the predetermined rotation angular positions, the eccentric cams are, specifically, brought into abutment with the abovementioned spinning rollers (34, 35). In other words, the first eccentric cam 50 fixed to one end of the penetrating shaft member 24*a* is brought into abutment with the first spinning roller 34 of the secondary transfer facing roller 24. At the same time, the second eccentric cam 51 fixed to the other end of the penetrating shaft member 24*a* is brought into abutment with the second spinning roller 35 of the secondary transfer facing roller 24. The spinning roller (34, 35) that are brought into abutment with the eccentric cams (50, 51) of the secondary transfer facing roller 24 are prevented from rotating upon abutment, but the rotation of the secondary transfer roller 30 is not interrupted. Even when the spinning rollers (34, 35) stop rotating, the shaft members (32, 33) of the secondary transfer roller 30 can freely rotated independently from the spinning rollers because the spinning rollers function as ball bearings. By causing the spinning rollers (34, 35) to stop rotating as they abut with the eccentric cams (50, 51), it is possible to avoid not only the generation of friction therebetween, but also the increase of the torque of the belt driving motor or the driving motor of the secondary transfer roller 30 that is caused by the friction.

Figure 5:
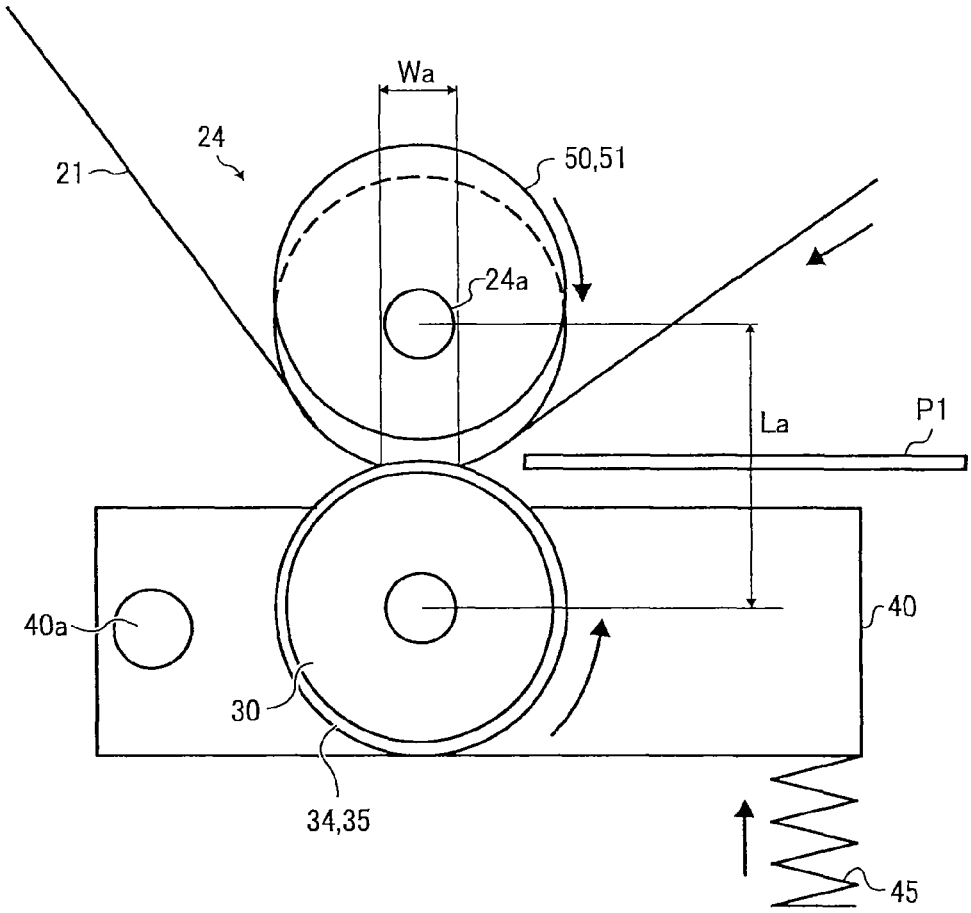
FIG. 5 is an enlarged schematic diagram showing a state of the secondary transfer nip immediately before the entry of a piece of regular paper.

FIG. 5 shows a state of the secondary transfer nip obtained immediately before the entry of a piece of regular paper $P_1$ functioning as the recording sheet. In this copying machine, when the regular paper $P_1$ is allowed to enter the secondary transfer nip, as shown in the diagram, the rotation of the penetrating shaft member 24*a* of the secondary transfer facing roller 24 is stopped at a position where the eccentric cams (50, 51) of the secondary transfer facing roller 24 are not brought into abutment with the spinning rollers (34, 35) of the secondary transfer roller 30. In other words, when using the regular paper $P_1$, the secondary transfer roller 30 is not pushed down by the eccentric cams (50, 51). This is because a significant load fluctuation does not occur on the belt or the secondary transfer roller 30 at the time of the entry into the secondary transfer nip, even when the secondary transfer roller 30 is not pushed down when the comparatively thin regular paper $P_1$ is used.

Figure 6:
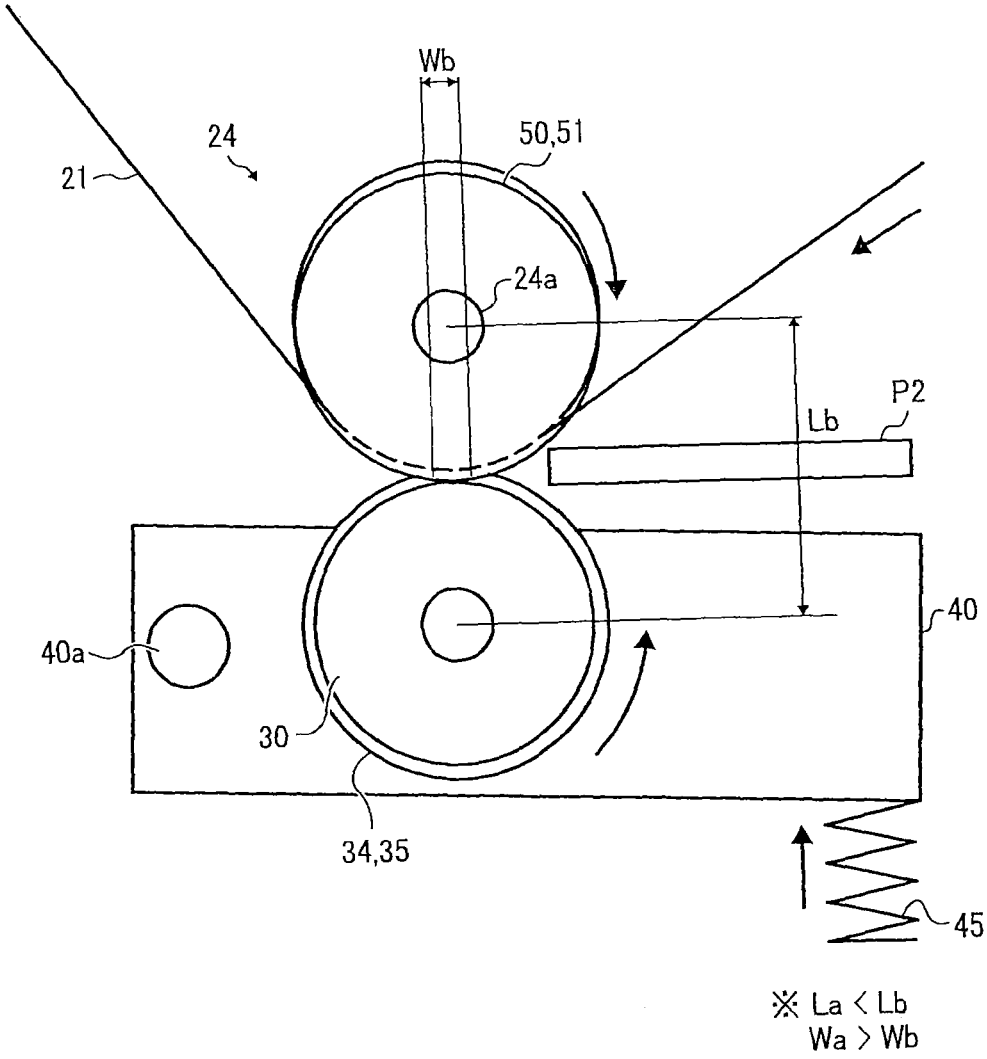
FIG. 6 is an enlarged schematic diagram showing a state of the secondary transfer nip immediately before the entry of a piece of cardboard.

FIG. 6 shows a state of the secondary transfer nip obtained immediately before the entry of a piece of cardboard $P_2$ functioning as the recording sheet. In this copying machine, when the cardboard $P_2$ is allowed to enter the secondary transfer nip, as shown in the diagram, the rotation of the penetrating shaft member 24*a* of the secondary transfer facing roller 24 is stopped at a position where the eccentric cams (50, 51) of the secondary transfer facing roller 24 are brought into abutment with the spinning rollers (34, 35) of the secondary transfer roller 30. In other words, when using the cardboard $P_2$, the secondary transfer roller 30 is pushed down by the eccentric cams (50, 51). This is because a significant load fluctuation occurs on the belt or the secondary transfer roller 30 at the time of the entry into the secondary transfer nip, when the secondary transfer roller 30 is pushed down when the comparatively large cardboard $P_2$ is used.

In order to clarify the comparison between FIGS. 5 and 6, the length Wb of the secondary transfer nip in the belt movement direction that is obtained when the secondary transfer roller 30 is pushed down by the eccentric cams (50, 51) is shorter than the length Wa obtained when the push down is not performed. On the other hand, an inter-shaft distance Lb between the secondary transfer facing roller 24 and the secondary transfer roller 30 that is obtained when the push down is performed is longer than an inter-shaft distance La obtained when the push down is performed. By increasing the inter-shaft distance, the pressing force of the secondary transfer roller 30 onto the intermediate transfer belt 21 is weakened, reducing the pressure of the secondary transfer nip. As a result, the drastic increase of the load on the belt or roller that can be caused when the cardboard $P_2$ enters the secondary transfer nip can be prevented.

The five inventors of the present invention have carried out an experiment for examining the relationship between the inter-shaft distances and fluctuations of the dot diameter by using a copy test machine having the same configuration as the copying machine shown in FIG. 1. Specifically, when the intermediate transfer belt 21 stably travels at a designed speed, there is almost no linear speed difference between the photosensitive drums and the belt at the primary transfer nip where the toner images are transferred from the photosensitive drums to the belt. In this state, each of dots configuring each toner image is primarily transferred to the belt while keeping the shape of the dot (circular shape). On the other hand, when the traveling speed of the intermediate transfer belt 21 drops instantaneously due to a drastic increase of the torque when the cardboard enters the secondary transfer nip, a linear speed difference is generated between the photosensitive drums and the belt at this moment. Due to this linear speed difference, each dot is expanded to an oval shape in a photosensitive drum surface movement direction and then primary transferred to the belt. Therefore, the dot diameter becomes larger than usual. In order to examine the relationship between the difference in dot diameter and the push-down amount of the secondary transfer roller 30 obtained by the eccentric cams, the copy test machine was used to output a predetermined dot pattern image under various conditions of the push-down amount. A piece of cardboard having a basis weight of 300 [g/m$^2$] was used as the recording sheet.

Figure 7:
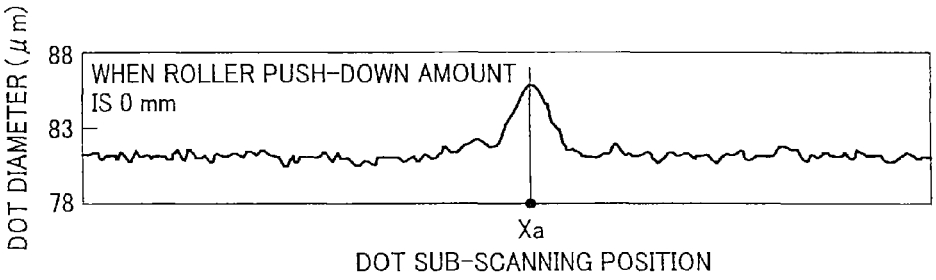
FIG. 7 is a graph showing a relationship between a dot diameter and a dot sub scanning position that are obtained when a dot pattern image is output under the condition that a secondary transfer roller is not pushed down.

FIG. 7 is a graph showing a relationship between the dot diameter and a dot sub scanning position that are obtained when the dot pattern image is output under the condition that the secondary transfer roller 30 is not pushed down. Note that the dot sub scanning position means a position of a dot on the recording sheet in the sheet conveying direction. In this diagram, the moment when a dot formed at a sub scanning position Xa is primarily transferred from a photosensitive drum to the belt is also a moment when a tip end of the cardboard enters the secondary transfer nip (to be referred to as "sheet tip end entry" hereinafter). Under the condition that the push-down amount of the secondary transfer roller 30 is set at zero, the diameter of the dot located in the sub scanning position Xa is much larger than the diameter of a dot located in the other position. This is because the load on the belt drastically increases upon the sheet tip end entry under the abovementioned condition, reducing the movement speed of the belt instantaneously.

Figure 8:
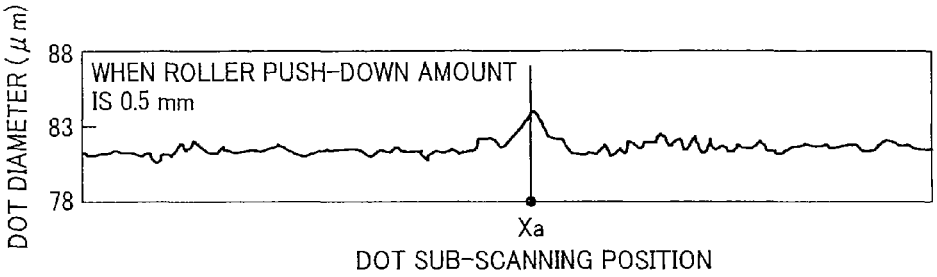
FIG. 8 is a graph showing a relationship between a dot diameter and a dot sub scanning position that are obtained when a dot pattern image is output under the condition that the push-down amount of the secondary transfer roller is set at 0.5 [mm]

FIG. 8 is a graph showing a relationship between the dot diameter and the dot sub scanning position that are obtained when the dot pattern image is output under the condition that the push-down amount of the secondary transfer roller 30 is set at 0.5 [mm]. Under this condition, compared to the condition that the push-down amount is set at zero, the increase of the dot diameter upon the sheet tip end entry is prevented, but the dot diameter obtained upon the sheet tip end entry is larger than usual. This is because the instantaneous decrease of the speed of the belt upon the sheet tip end entry is not completely resolved.

Figure 9:
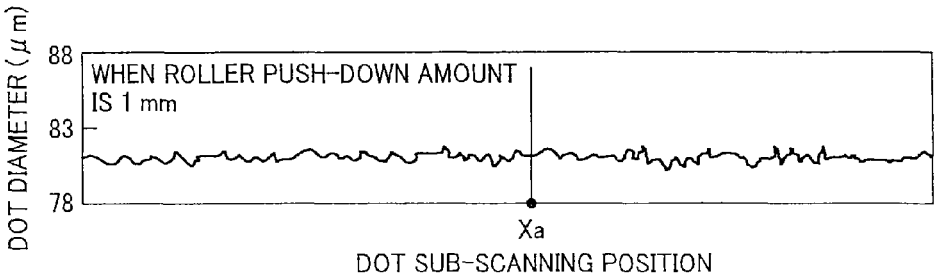
FIG. 9 is a graph showing a relationship between a dot diameter and a dot sub scanning position that are obtained when a dot pattern image is output under the condition that the push-down amount of the secondary transfer roller is set at 1.0 [mm]

FIG. 9 is a graph showing a relationship between the dot diameter and the dot sub scanning position that are obtained when the dot pattern image is output under the condition that the push-down amount of the secondary transfer roller 30 is set at 1.0 [mm]. In this condition, the increase of the dot diameter upon the sheet tip end entry is completely resolved. This is because the instantaneous decrease of the speed of the belt upon the sheet tip end entry is completely resolved. This result confirms that the instantaneous decrease of the speed of the belt upon the sheet tip end entry can be resolved by appropriately setting the push-down amount.

Figure 10:
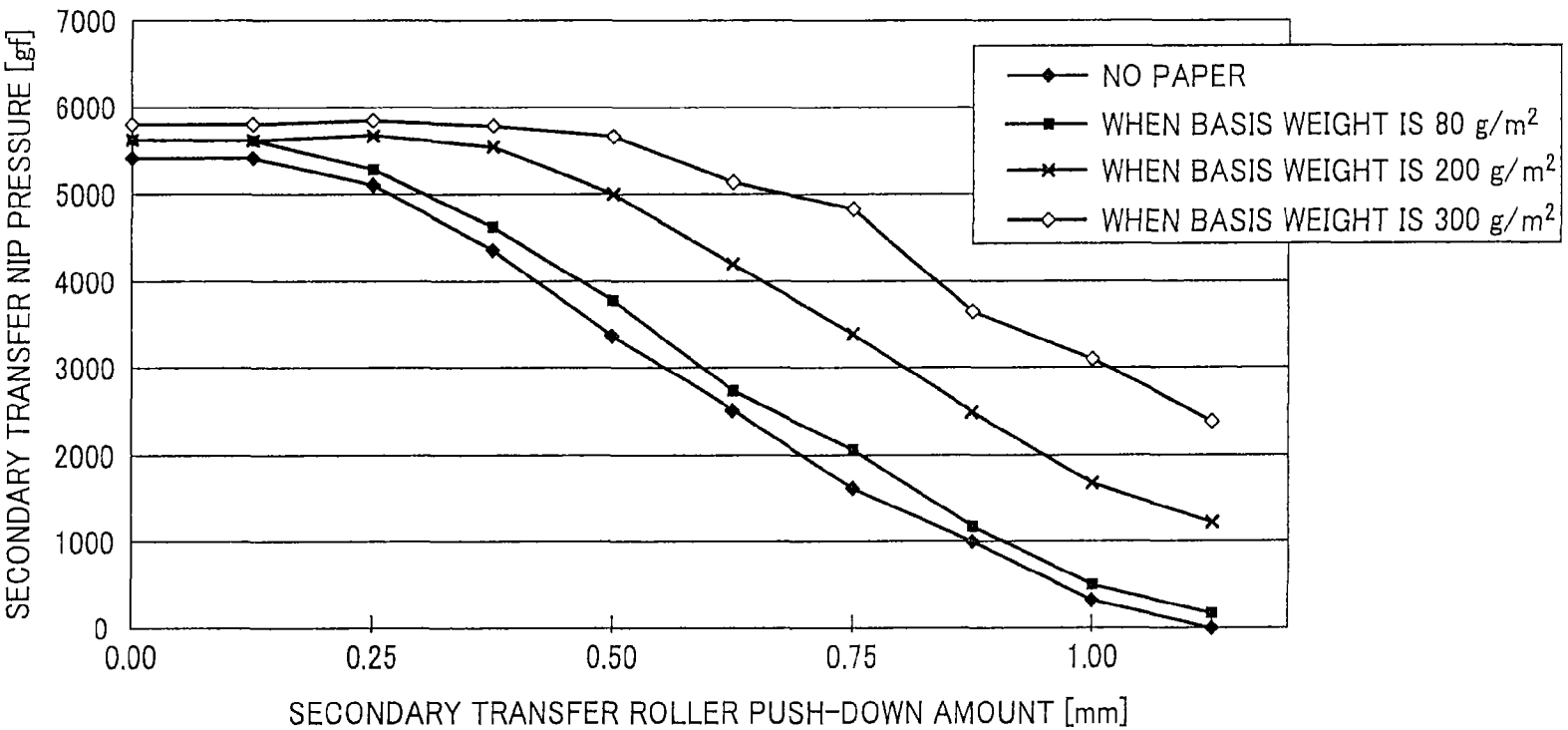
FIG. 10 is a graph showing a relationship among secondary transfer nip pressure obtained when the recording sheet is interposed in the nip, the push-down amount of the secondary transfer roller and the thickness of a recording sheet.

Next, the inventors have carried out an experiment for examining the relationship among the secondary transfer nip pressure obtained when the recording sheet is interposed in the nip, the push-down amount of the secondary transfer roller 30, and the thickness of the recording sheet. Three types of paper were used as the recording sheets: a piece of cardboard having a basis weight of 300 [g/m$^2$] (the thickness is approximately 320 μm), a piece of medium cardboard having a basis weight of 200 [g/m$^2$] (the thickness is approximately 200 μm), and a piece of regular paper having a basis weight of 80 [g/m$^2$] (the thickness is approximately 90 μm). The result is shown in FIG. 10. As shown in the diagram, under the same condition of the push-down amount, the secondary transfer nip with the sheet therein decreases as the thickness of the recording sheet becomes thin. Because the secondary transfer nip has to be within a constant range regardless of the thickness of the recording sheet in order to realize good secondary transfer, the push-down amount needs to be set according to the thickness of the recording sheet. When the push-down amount is set at the same level for the cardboard and the regular paper, the increase of the dot diameter upon the sheet tip end entry can be avoided. However, transfer failure occurs in the regular paper due to a lack of nip pressure, or a significant increase of the dot diameter occurs upon the sheet tip end entry in the case of the cardboard, although the transfer failure can be avoided.

Therefore, this copying machine is provided with thickness information acquisition means for acquiring thickness information of the recording sheet supplied to the secondary transfer nip. The controller, which is a part of the distance adjusting means, is configured so as to adjust the push-down amount of the secondary transfer roller 30 in response to the result of acquisition by the thickness information acquisition means. Specifically, a ROM or other data storage means of the controller has stored therein a data table showing the relationship between the thickness of the recording sheet and a rotation stop position (same as the push-down amount) of the penetrating shaft member 24*a*, which corresponds to the thickness of the recording sheet. The controller is configured to execute a process of specifying from the data table the rotation stop position corresponding to the result of acquisition of the thickness of the recording sheet, rotating the penetrating shaft member 24*a* up to the rotation stop position, and thereafter allowing the recording sheet to enter the secondary transfer nip. In this manner, the inter-shaft distance corresponding appropriately to the thickness of the recording sheet can be set, and the transfer failure caused by a lack of nip pressure and the increase of the dot diameter upon the sheet tip end entry can be prevented.

Note that the controller is so configured that it can learn the rotation stop position of the penetrating shaft member 24*a* based on the timing when the optical sensor 60 detects the detected part 59*a* of the detected disk 59 and the amount of drive of the cam driving motor 58 obtained from this timing, as described above.

As the thickness information acquisition means, a thickness detection sensor for actually detecting the thickness of the recording sheet conveyed in the sheet feeding path 99 may be used. Data inputting means for receiving a data input of the thickness information from an operator may also be used. In addition, examples of the thickness detection sensor include an optical sensor for detecting a light transmission rate in the thickness direction, and a sensor for detecting the amount of roller movement obtained when the recording sheet is held between the conveying rollers.

In this copying machine, because the roller part 24*a* is spun on the circumferential surface of the penetrating shaft member 24*a* of the secondary transfer facing roller 24, the rotation of the roller part 24*a* is not affected by the abutting state of the eccentric cams (50, 51) serving as the abutting members fixed to the penetrating shaft member 24*a*. Moreover, because the spinning roller (34, 35) serving as abutted members are spun on the shaft members (32, 33) in the secondary transfer roller 30, the rotation of the secondary transfer roller 30 is not affected by the abutted state of the spinning rollers. As a result, even during a print job, the push-down amount of the secondary transfer roller 30 can be changed in response to continuous feeding of the recording sheets with different thicknesses.

In FIG. 3 described above, when the secondary transfer current leaks from the front roller to the rear roller through the abutting part where the eccentric cams (50, 51) of the secondary transfer facing roller 24 are brought into abutment with the spinning rollers (34, 35) of the secondary transfer roller 30, a secondary transfer electric field with appropriate strength cannot be formed within the secondary transfer nip. For this reason, it is desired that at least either the eccentric cams or the spinning rollers be configured by an insulating material. In this copying machine, the abovementioned leakage is prevented by using the eccentric cams (50, 51) made of polyacetal resin that is an insulating material.

The spinning rollers (34, 35) may be configured by a resin, but desirably a highly rigid resin is used so that the spinning rollers are not deformed by the pressure from the eccentric cams (50, 51). For this reason, this copying machine uses spinning rollers configured by metallic ball bearings. Such spinning rollers are not deformed by the pressure of the eccentric cams and do not affect the accuracy of the rotation position of the secondary transfer roller 30. Furthermore, wear of the eccentric cams can be alleviated because such spinning rollers have excellent slidability.

The above has described the copying machine that uses the endless belt-like intermediate transfer belt 21 that is wrapped around the secondary transfer facing roller 24 serving as a rotatable support rotating body and endlessly moved. However, the present invention can be applied by configuring at least either the image carrier such as the intermediate transfer belt, or the facing member such as the transfer roller, by using the belt member or rotating body supported on the support rotating body.

For example, in the configuration where the transfer nip is formed by pushing the drum-like photosensitive drum serving as the rotating body against the immobile transfer member that does not perform surface movement, the following may be performed. In other words, the rotatable drum-like photosensitive drums may be configured by at least the main body part and the penetrating shaft member, and the eccentric cams formed integrally with the penetrating shaft member may be brought into abutment with the transfer member biased by the biasing means.

Furthermore, in the configuration where the transfer nip is formed by pushing the immobile transfer member that does not perform surface movement, against a photosensitive belt or the intermediate transfer belt that is wrapped around the rotatable support rotating body and endlessly moved, the following may be performed. In other words, a supporting roller wrapped with the photosensitive belt or intermediate transfer belt may be configured by at least the main body part or the penetrating shaft member, and the eccentric cams formed integrally with the penetrating shaft member may be brought into abutment with the transfer member biased by the biasing means.

Moreover, in the configuration where the transfer nip is formed by pushing the sheet conveying belt against the photosensitive belt or intermediate transfer belt wrapped around the supporting roller and endlessly moved, the sheet conveying belt being wrapped around a supporting roller and endlessly moved, the following may be performed. In other words, either one of the two supporting rollers may be configured by at least the main body part and the penetrating shaft member, and the eccentric cams formed integrally with the penetrating shaft member may be brought into abutment with the other support roller biased by the biasing means.

As described above, the copying machine according to this embodiment has the following characteristics.

(1) The endless belt-like intermediate transfer belt 21 that is wrapped around the secondary transfer facing roller 24 serving as the support rotating body is used as the image carrier, to configure the secondary transfer facing roller 24 by means of at least the roller part 24*b* serving as the main body part and the penetrating shaft member 24*a*, and the roller part 24*b* is driven-rotated on the surface of the penetrating shaft member 24*a* as the intermediate transfer belt 21 endlessly moves. In this configuration, the degree of freedom of the layout of the distance adjusting means for adjusting the relative distance between the endless intermediate transfer belt 21 and the secondary transfer roller 30 can be improved compared with the conventional technology.

(2) The distance adjusting means configured by the controller or eccentric cams is configured to execute the operation for forcibly pushing the secondary transfer roller 30 away from the belt against the biasing force of the biasing coil spring 45 by means of the abutment of the eccentric cams (50, 51), and increasing the relative distance between the belt and the roller, prior to the entry of the recording sheet into between the intermediate transfer belt 21 and the secondary transfer roller 30. According to such configuration, as described earlier, the increase of the dot diameter caused by an instantaneous decrease of the movement speed of the belt upon the sheet tip end entry can be prevented.

(3) Note that the distance adjusting means configured by the controller or eccentric cams is configured to execute the operation for forcibly pushing the secondary transfer roller further away from the belt against the biasing force of the biasing coil spring 45 by means of the abutment of the eccentric cams, and increasing the relative distance between the belt and the roller, before discharging the recording sheet between the intermediate transfer belt 21 and the secondary transfer roller 30, from therebetween. According to such configuration, when the recording sheet is interposed between the belt and the roller at the secondary transfer nip, the roller is pressed against the belt with sufficient force to secure a necessary secondary transfer nip. Meanwhile, when discharging a sheet rear end, the relative distance is made large in advance, so that an instantaneous increase of the speed of the belt due to a drastic drop of the load during the discharge can be prevented.

(4) Furthermore, the first eccentric cam 50 and the second eccentric cam 51 of the longitudinal direction both ends of the penetrating shaft member 24*a* are fixed to the penetrating shaft member 24*a* in its longitudinal direction, with a distance greater than the width of the intermediate transfer belt 21 therebetween. According to such configuration, the intermediate transfer belt 21 can be endlessly moved between the first eccentric cam 50 and the second eccentric cam 51.

(5) The longitudinal direction both ends of the secondary transfer roller 30 are provided with the spinning rollers (34, 35) serving as the abutted members brought into abutment with the eccentric cams (50, 51), such that the spinning rollers can spin on the surfaces of the rotary shaft members (32, 33). According to this configuration, by spinning the spinning rollers (34, 35) on the shaft members (32, 33), the secondary transfer roller 30 can be rotated well, while stopping the rotation of the spinning rollers abutted with the eccentric cams. As a result, not only a friction between each eccentric cam and each spinning roller, but also the increase of the torque of the belt or roller caused by the friction can be prevented.

(6) Distance detection means (configured by the detected disk 59, the optical sensor 60, the controller and the like) for detecting the relative distance between the belt and the secondary transfer roller 30 is provided, and the controller for adjusting the rotation stop position of the penetrating shaft member 24*a* based on the result of the detection performed by the distance detecting means is configured as a part of the distance adjusting means. According to this configuration, the push-down amount of the secondary transfer roller 30 can be freely adjusted to a desired value, on the basis of the rotation stop position of the penetrating shaft member 24*a*.

(7) Furthermore, at least the eccentric cams (50, 51) or the spinning rollers (34, 35) are configured by an insulating material. According to this configuration, leakage of the transfer current through the abutting part between the eccentric cams and the spinning rollers can be avoided.

(8) Because the eccentric cams (50, 51) are used as the abutting members, the push-down amount, which is the relative distance between the belt and the roller, can be freely and steplessly adjusted by the stepless cam surfaces.

(9) The thickness information acquisition means for acquiring the thickness information of the recording sheet supplied to the secondary transfer nip is provided, and the controller is configured as a part of the distance adjusting means so as to adjust the push-down amount based on the result of the detection. Hence, the push-down amount can be adjusted to an appropriate value corresponding to the sheet thickness.

As described above, in the first embodiment, the rotating body configuring the image carrier or the facing member, or the support rotating body of the belt member that configures the image carrier or the facing member rotates the cylindrical main body part freely on the penetrating shaft member penetrating the main body part. One end side and the other end side in the shaft line direction of the penetrating shaft member are provided with cams that rotate integrally with the penetrating shaft member. When the penetrating shaft member rotates, the cams fixed to the both ends in the shaft line direction of the penetrating shaft member rotate integrally. Therefore, these cams can be rotated by providing either one of the both ends in the shaft line direction with the drive transmission mechanism for transmitting the drive to the penetrating shaft member. Consequently, unlike the conventional technology that needs to provide the drive transmission mechanism on both end sides, the degree of freedom of the layout of the distance adjusting means can be improved.

2nd Embodiment

This second embodiment accomplishes mainly the second object described above.

Hereinafter, the second embodiment of a tandem image forming apparatus to which the present invention is applied is described.

Figure 11:
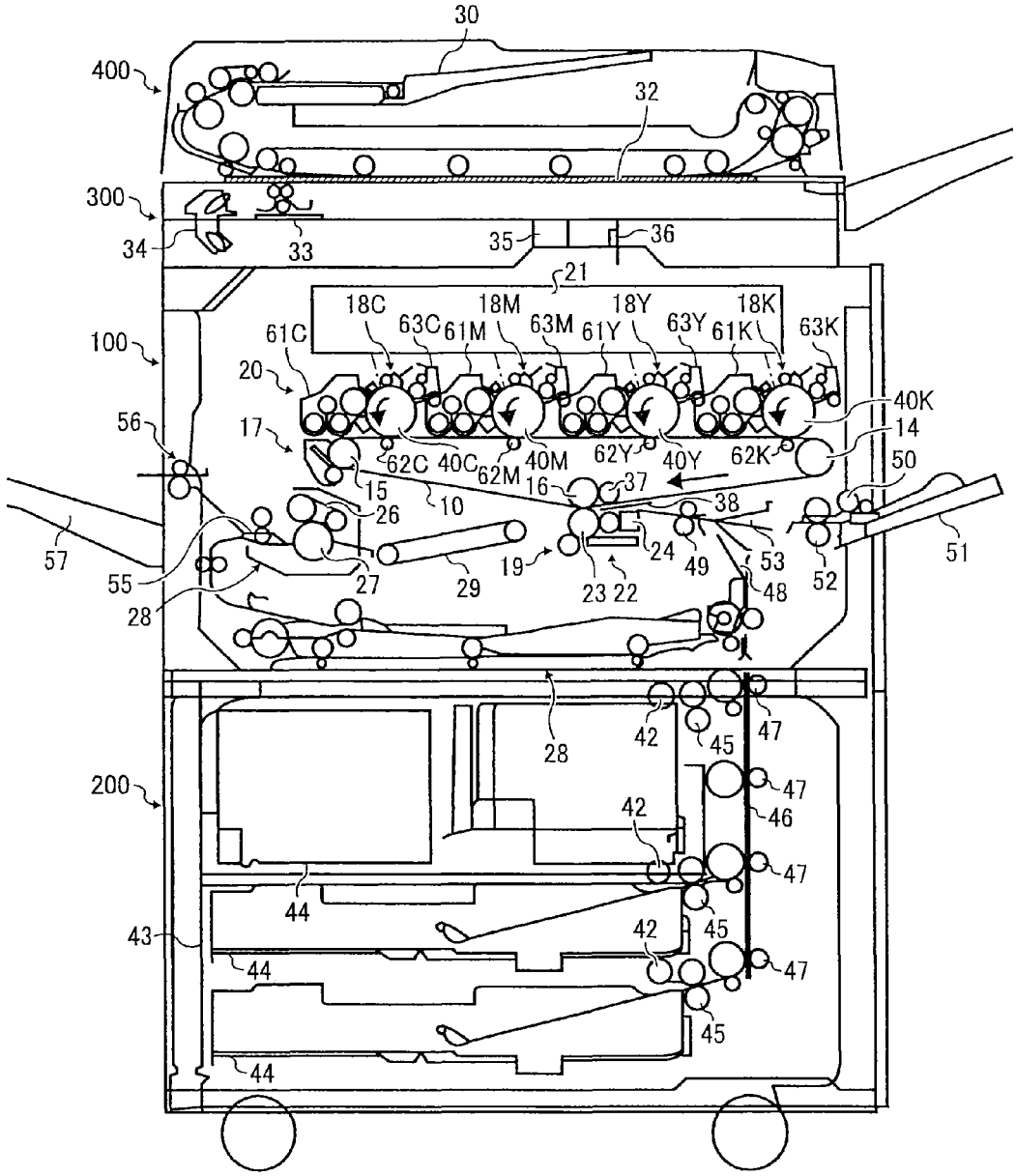
FIG. 11 is a diagram showing a schematic configuration of an image forming apparatus according to a second embodiment of the present invention.

FIG. 11 shows a configuration of an example of the image forming apparatus according to this embodiment. This image forming apparatus is configured mainly by a copying machine main body 100, a sheet feeding table 200 on which the copying machine main body 100 is placed, a scanner 300 attached onto the copying machine main body 100, and an automatic document feeder (ADF) 400 attached onto the scanner 300.

In the scanner 300, an unshown document that is placed on a contact glass 32 is subjected to reading scanning in response to a reciprocal movement of a first traveling body 33 having a document illumination light source or a mirror placed thereon, and a second traveling body 34 having a plurality of reflecting mirrors placed thereon. An imaging lens 35 focuses scanning light, which is sent out from the second traveling body 34, on to an imaging surface of a reading sensor 36 installed in the back of the imaging lens 35. Thereafter, the scanning light is read as an image signal by the reading sensor 36.

The copying machine main body 100 is provided with photosensitive drums 40Y, 40C, 40M and 40K serving as latent image carriers and corresponding to yellow, cyan, magenta and black toners. Means for executing electrophotographic processes including charging, developing and cleaning processes is disposed around each photosensitive drum 40, whereby each image forming unit 18 is formed. Four of the image forming units 18 are arranged parallel, forming a tandem-type image forming apparatus 20.

In a developing device 61 of each of the image forming units 18, developers containing the abovementioned four toners are used. In the developing device 61, a developer carrier carries and conveys each developer, and an alternate electric field is applied at a position where the developer carrier faces each photosensitive drum 40, whereby a latent image on the photosensitive drum 40 is developed. The application of the alternate electric field activates the developer, and the charge amount distribution of the toners can be further narrowed down, improving the developing performance. Also, a process cartridge can be obtained by supporting the developing device 61 integrally with the photosensitive drum 40 and forming the developing device 61 attachable/detachable with respect to the image forming apparatus main body. This process cartridge can also include charging means and cleaning means.

An upper part of the tandem-type image forming apparatus 20 is provided with an exposure device 21 that exposes the photosensitive drum 40 with a laser beam or LED light to form a latent image, based on image information.

Furthermore, an intermediate transfer belt 10 configured by an endless belt member is disposed in a lower position where the tandem-type image forming apparatus 20 faces the photosensitive drum 40. The intermediate transfer belt 10 is supported by supporting rollers 14, 15 and 16. A primary transfer device 62 that transfers the toner image of each color formed on the photosensitive drum 40 to the intermediate transfer belt 10 is disposed in an adjacent position opposite to the photosensitive drum 40 across the intermediate transfer belt 10. The intermediate transfer belt 10 is provided with a cleaning device 17 for removing the toner remaining on the surface of the intermediate transfer belt. A cleaning blade of the cleaning device 17, which is made of, for example, a fur brush or urethane rubber, is brought into abutment with the intermediate transfer belt 10 to scrape secondary transfer residual toner on the intermediate transfer belt 10.

A secondary transfer device 19, which transfers, at once, toner images superimposed on the surface of the intermediate transfer belt 10 to a transfer sheet conveyed from a sheet feeding tray 44 of the sheet feeding table 200, is disposed in a lower part of the intermediate transfer beltl 10. The secondary transfer belt 19 has a secondary transfer roller 23. The secondary transfer device 19 pushes the secondary transfer roller 23 against the supporting roller 16 via the intermediate transfer belt 10, and transfers the toner images formed on the intermediate transfer belt 10 to the unshown transfer sheet. Hereinafter, the supporting roller 16 is referred to as "secondary transfer backup roller 16."

A conveying belt device 29 for conveying the transfer sheet is provided adjacent to the secondary transfer device 19, and a fixing device 28 is provided in a downstream of the conveying belt device 29. The fixing device 28 fixes the image formed on the transfer sheet. The fixing device 28 is configured mainly by an endless fixing belt 26, and a pressure roller 27 that is pressed against the fixing belt 26. An inverting device for inverting the transfer sheet is disposed in a lower part of the secondary transfer device 19 and fixing device 28. The inverting device inverts the transfer sheet in order to record the image on both sides of the transfer sheet.

An operation of this tandem-type image forming apparatus having the above configuration is described next.

A document is set on a document table 30 of the automatic document feeder 400 shown in FIG. 11 or on the contact glass 32 of the scanner 300 by opening the automatic document feeder 400, and the automatic document feeder 400 is closed. In this state, an activation switch, which is not shown, is pushed. When the document is set in the automatic document feeder 400, the document is conveyed onto the contact glass 32, and thereafter the scanner 300 is driven. On the other hand, when the document is set on the contact glass 32, the scanner 300 is driven immediately. Then, the first traveling body 33 and the second traveling body 34 start traveling. A light beam is emitted from the light source of the first traveling body 33, and thus obtained reflected light is received from the surface of the document and reflected by the second traveling body 34. The reflected light is further reflected by the mirror of the second traveling body 34 and enters the reading sensor 36 through the imaging lens 35. In this manner, the contents of the document are read by the reading sensor 36.

By pressing the activation switch of the apparatus, an unshown driving motor is driven to rotate and drive one of the supporting rollers 14, 15 and 16, and to driven-rotate the other two supporting rollers. As a result, the intermediate transfer belt 10 is rotated. At the same time, in each image forming unit 18, the photosensitive drum 40 is uniformly charged by a charger. Subsequently, a writing light beam L in the form of a laser or LED is emitted from the exposure device 21 in accordance with the contents read by the scanner 300, and an electrostatic latent image is formed on each photosensitive drum 40. The toners are supplied from the developing device 61 to the photosensitive drum 40 formed with the electrostatic latent image, to make the electrostatic latent image visible. As a result, single-color images of black, yellow, magenta and cyan are formed on the respective photosensitive drum 40. The single-color images are primarily transferred by the primary transfer device 62 by sequentially superimposing them on the intermediate transfer belt 10, whereby a composite color image is formed on the intermediate transfer belt 10. For the next image formation, a photosensitive drum cleaning device, which is not shown, removes the residual toner from the surface of the photosensitive drum 40 after the image transfer, and the electricity on the same surface is removed by an unshown neutralization device.

By pressing the activation switch, one of sheet feeding rollers 42 of the sheet feeding table 200 is selected and rotated, and transfer sheets are brought out of one of sheet feeding cassettes 44 provided in multiple stages within a paper bank 43. The transfer sheets are separated one by one by a separation roller 45, and a separated transfer sheet is inserted into a sheet feeding path 46. The transfer sheet is conveyed to a sheet feeding path 48 of the copying machine main body 100 by a conveying roller 47, brought into contact with a resist roller 49 and then stopped. On the other hand, when the sheets are fed manually, a sheet feeding roller 50 is rotated to bring out the sheets on a manual tray 51 and separated one by one by a separation roller 52. A separated sheet is inserted into a manual sheet feeding path 53, brought into contact with the resist roller 49 in a similar way, and then stopped. Next, the resist roller 49 is rotated in synchronization with the composite color image on the intermediate transfer belt 10, and a sheet is sent to between the intermediate transfer belt 10 and the secondary transfer device 19. Then, the color image is transferred onto the sheet by the secondary transfer device 19.

The sheet that has passed through the secondary transfer roller 23 and carries an unfixed toner image is conveyed to the fixing device 28, and is then applied with heat and pressure by the fixing device 28, whereby the transferred image is fixed as a permanent image. The passage is switched by a switching click 55 so that the sheet obtained after fixing the image thereto is discharged by a discharge roller 56. The sheet is stacked on a catch tray 57 or guided to a sheet inverting device after switching the passage using the switching click 55. The sheet is then inverted and guided to the transfer position again where the image is recorded on the back of the sheet as well. Thereafter, the sheet is discharged to the catch tray 57 by the discharge roller 56. At this moment, the residual toner remaining on the intermediate transfer belt 10 after the image transfer is removed by the cleaning device 17, for the next image formation performed by the tandem-type image forming apparatus 20.

Figure 12:
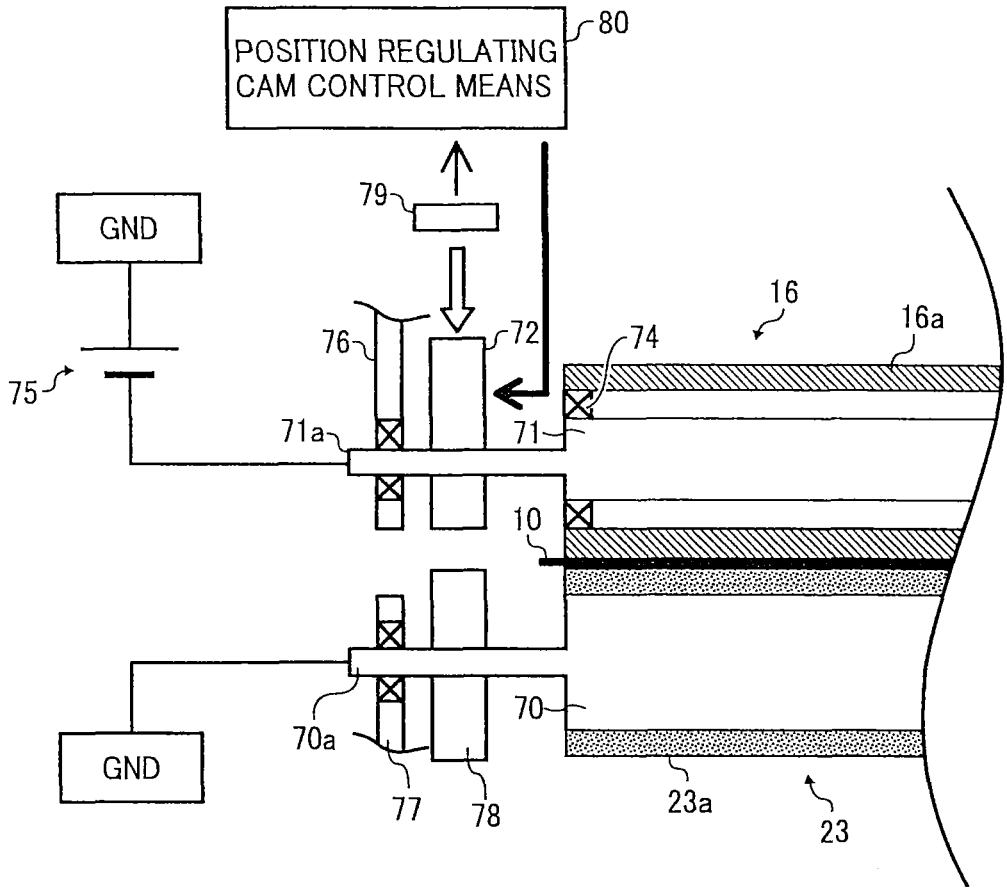
FIG. 12 is a cross-sectional diagram showing a configuration of substantial parts of a secondary transfer part.

A secondary transfer part of the secondary transfer device 19, which is a characteristic part of this embodiment, is described next. FIG. 12 is a cross-sectional diagram showing an image forming apparatus depth direction of a secondary transfer part of the image forming apparatus.

The configuration of the secondary transfer part is described with reference to FIG. 12.

The secondary transfer roller 23 has a metallic electrically conductive shaft part 70 that is in the form of a cylinder, and an electrically conductive elastic layer 23*a* that covers an outer circumferential surface of the shaft part 70. The secondary transfer backup roller 16 has a metallic electrically conductive shaft part 71 that is in the form of a cylinder, and an electrically conductive surface elastic layer 16*a* that is configured to be freely rotatable with the shaft part 71 by a ball bearing 74. The secondary transfer roller 23 is applied with a pressing force of an unshown pressure spring and is thereby pressed against the secondary transfer backup roller 16 via the intermediate transfer belt 10, whereby a secondary transfer nip is formed. A transfer electric field is formed in this secondary transfer nip, as described hereinafter, and the toner images on the intermediate transfer belt 10 are transferred to the transfer sheet.

Shaft end parts 70*a* on both ends of the shaft part 70 of the secondary transfer roller 23 have abutting rollers 78 serving as abutting members. A position regulating cam 72 serving as a position regulating member is provided to each shaft end part 71*a* on each end of the shaft part 71 of the backup roller 16. Each of the abutting rollers 78 and each of the position regulating cams 72 are disposed on both ends on the outside of the intermediate transfer belt 10 in the width direction. An inner circumference of the intermediate transfer belt 10 has position regulating cam detection means 79 for detecting a rotation position of the position regulating cam 72 provided to the shaft end part 71*a* of the backup roller 16, and position regulating cam control means 80 for controlling the rotation position of the position regulating cam 72. This position regulating cam control means 80 includes unshown drive force transmission means for rotating the position regulating cam 72. These members function as gap forming means for separating the intermediate transfer belt 10 from the backup roller 16 to form a gap therebetween.

The position regulating cam control means 80 rotates the position regulating cam 72 provided to the shaft end part 71*a* of the backup roller 16. The position regulating cam 72 comes into abutment with the abutting rollers 78 provided to the shaft end parts 70*a* of the secondary transfer roller 23, whereby the abutting rollers 78 are pressed downward as shown in FIG. 2. As a result, the secondary transfer roller 23 moves away from the backup roller 16.

The surface elastic layer 16*a* of the backup roller 16 and the shaft part 71 are configured so as to be rotated freely by the ball bearing 74. The surface elastic layer 16*a* of the backup roller 16 is subjected to dragged rotation by the intermediate transfer belt 10, and the shaft end part 71*a* of the backup roller 16 is rotated along with the position regulating cam 72 by a drive force transmitted by the drive force transmission means (not shown) of the position regulating cam control means 80.

The shaft end part 71*a* of the backup roller 16 is supported rotatably by a first support plate 76, and the shaft end part 70*a* of the secondary transfer roller 23 is supported rotatably by a second support plate 77. Transfer voltage application means 75 for applying secondary transfer voltage is connected to the shaft end part 71*a* of the backup roller 16, while the shaft end part 70*a* of the secondary transfer roller 23 is connected to the ground. Secondary transfer voltage having the same polarity (negative polarity in the example shown in the diagram) as the toners is applied to the backup roller 16 by the transfer voltage application means 75, and a secondary transfer electric field for transferring the toner image formed on the intermediate transfer belt 10 to the transfer sheet is formed between the backup roller 16 and the secondary transfer roller 23.

Figure 13:
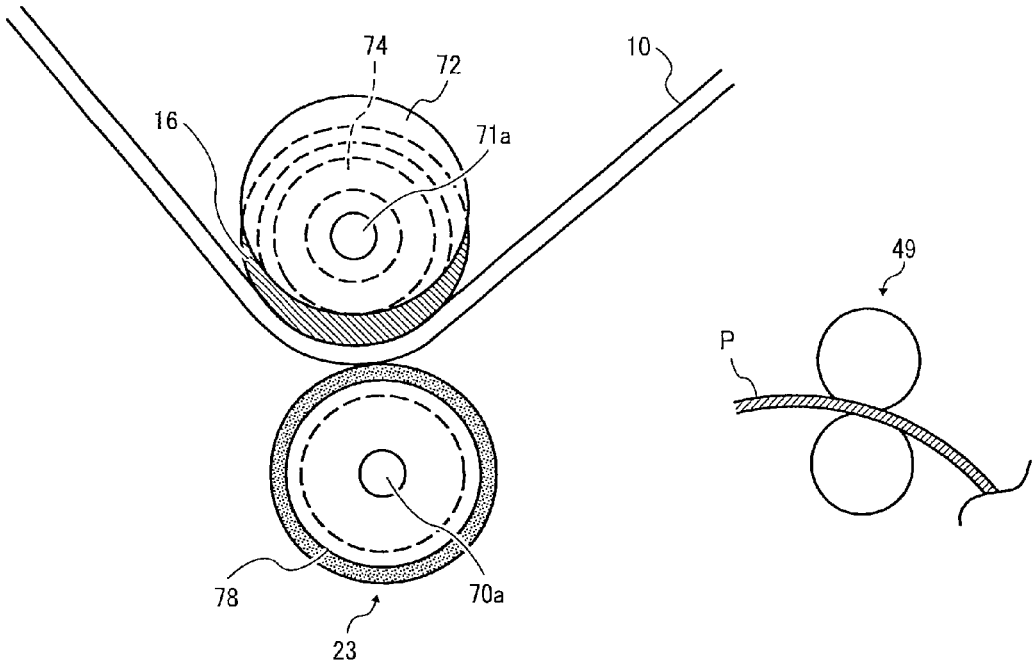
FIG. 13 is a diagram for explaining an operation of the secondary transfer part that is performed when a transfer sheet is fed toward a secondary transfer nip.

Next, an operation of the secondary transfer part performed when conveying a transfer sheet P toward the secondary transfer nip is described with reference to FIG. 13.

When print information is input to the image forming apparatus, the transfer sheet P is conveyed toward a secondary transfer nip part by the resist roller 49 at the timing when the transfer sheet P is brought to the position of the image on the intermediate transfer belt 10. At this moment, the position regulating cam 72 and the abutting roller 78 are separated from each other, and the secondary transfer roller 23 is pressed against the backup roller 16 via the intermediate transfer belt 10, by the pressing force of the pressure spring (not shown).

Figure 14:
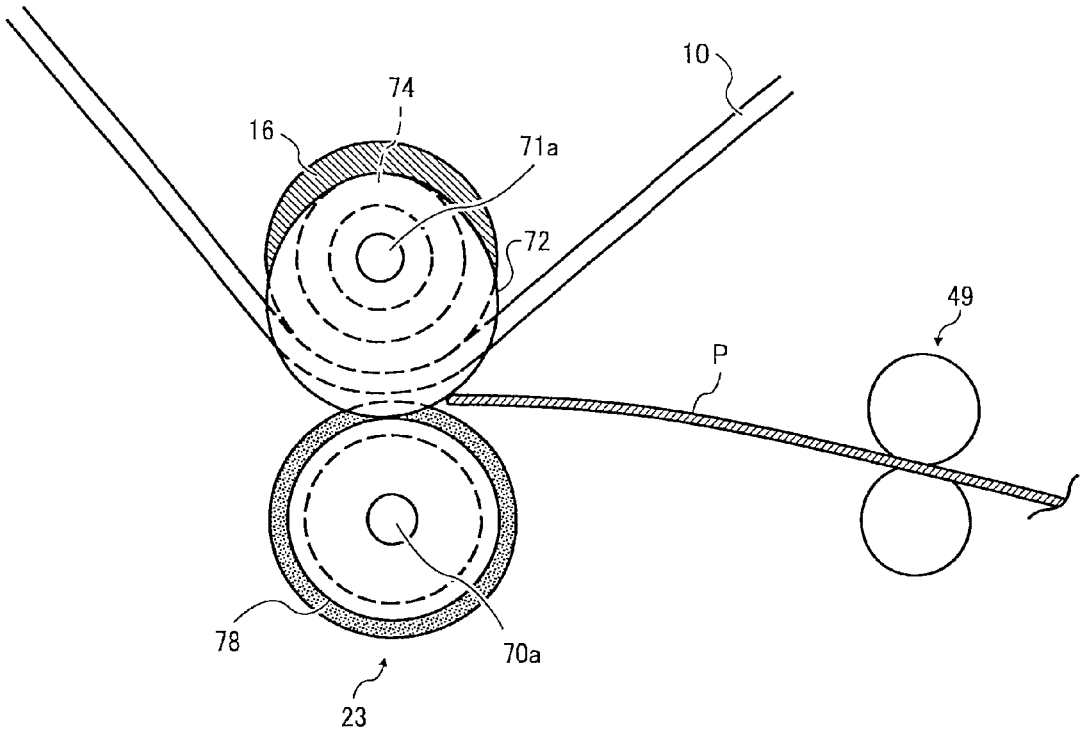
FIG. 14 is a diagram for explaining an operation of the secondary transfer part that is performed immediately before a transfer sheet tip end part enters the secondary transfer nip.

Next, an operation of the secondary transfer part that is performed immediately before a tip end part of the transfer sheet P enters the secondary transfer nip is described next with reference to FIG. 14. When the tip end part of the transfer sheet P is conveyed to a position immediately before the secondary transfer nip part, the drive force transmission means of the position regulating cam control means 80 rotates the position regulating cam 72 and bring it into abutment with the abutting roller 78, pressing the abutting roller 78 downward. By the rotation of the position regulating cam 72 and the pressing force of the pressure spring (not shown), the secondary transfer roller 23 is moved and positioned in a position that is away from the intermediate transfer belt 10 with a gap therebetween. As a result, shock generated when the tip end part of the transfer sheet P enters the secondary transfer nip part is alleviated, and image quality degradation caused by a fluctuation of the surface movement speed of the intermediate transfer belt 10 can be prevented.

It is preferred that the size of the gap between the secondary transfer roller 23 and the intermediate transfer belt 10 be changed according to the thickness of the transfer sheet P that is acquired by transfer sheet information acquisition means of the image formation apparatus. For example, when a piece of cardboard having a basis weight of 160 to 300 [g/m$^2$] is used as the transfer sheet P, the gap amount between the surface of the secondary transfer roller 23 and the surface of the intermediate transfer belt 10 is set at 0 to 0.5 [mm].

Prior to the entry of the transfer sheet P into the secondary transfer nip part, the voltage application means 75 starts applying the transfer voltage for transferring the image formed on the intermediate transfer belt 10 to the transfer sheet P. As a result, the output of the transfer voltage application means increases sufficiently and a sufficient transfer electric field can be formed until the transfer starts at an image tip end part. Consequently, transfer failure of the tip end part or another form of image degradation can be prevented. In addition, the transfer current that is induced at this moment flows from the shaft end part 71*a* of the backup roller 16 to the shaft end part 70*a* of the secondary transfer roller 23 through the position regulating cam 72 and the abutting roller 78 abutting with each other. Therefore, leak discharge is prevented from occurring in the gap between the surface of the secondary transfer roller 23 and the surface of the intermediate transfer belt 10, and the intermediate transfer belt 10 can be prevented from being damaged by the discharge.

Figure 15:
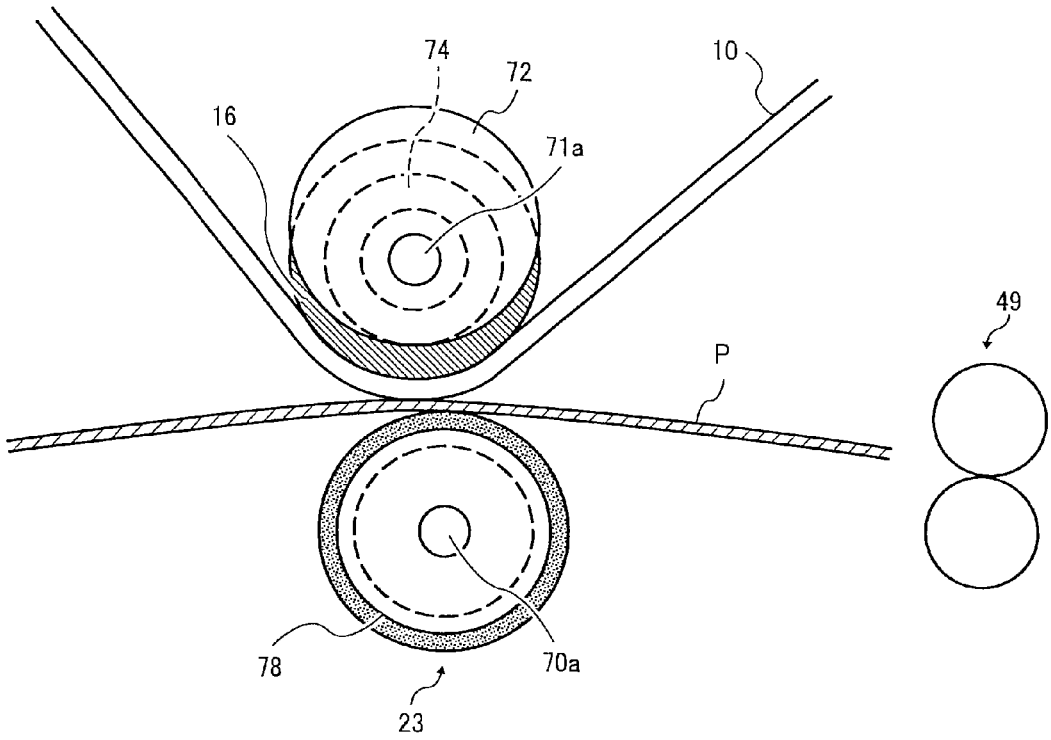
FIG. 15 is a diagram for explaining an operation of the secondary transfer part that is performed when a toner image is transferred to the transfer sheet in the secondary transfer nip.

Next, an operation of the secondary transfer part that is performed when transferring the toner images to the transfer sheet at the secondary transfer nip is described with reference to FIG. 15. The drive force transmission means of the position regulating cam control means 80 rotates the position regulating cam 72 until the image tip end part on the intermediate transfer belt 10 reaches the secondary transfer nip part after the tip end part of the transfer sheet P enters the secondary transfer nip part. The position regulating cam 72 separates from the abutting roller 78 as the position regulating cam 72 rotates, and the secondary transfer roller 23 is pressed against the backup roller 16 by the pressing force of the pressure spring (not shown) via the transfer sheet P and the intermediate transfer belt 10. Therefore, sufficient transfer pressure can be obtained when the image on the intermediate transfer belt 10 is transferred to the transfer sheet P, and hence good transfer can be realized.

Because the position regulating cam 72 is separated from the abutting roller 78, the transfer current flows from the backup roller 16 to the secondary transfer roller 23 through the transfer sheet P and the intermediate transfer belt 10. Therefore, a sufficient transfer electric field can be obtained in the secondary transfer nip, and hence good transfer can be realized. Note that when the abutting roller 78 and the position regulating cam 72 are separated from each other, the gap amount therebetween is set at approximately 3 to 5 mm, depending on the shape of the cam 72. In this manner, leak discharge caused by the secondary transfer current between the abutting roller 78 and the position regulating cam 72 can be prevented during the secondary transfer. In other words, the discharge can be prevented if the gap is large enough.

Figure 16:
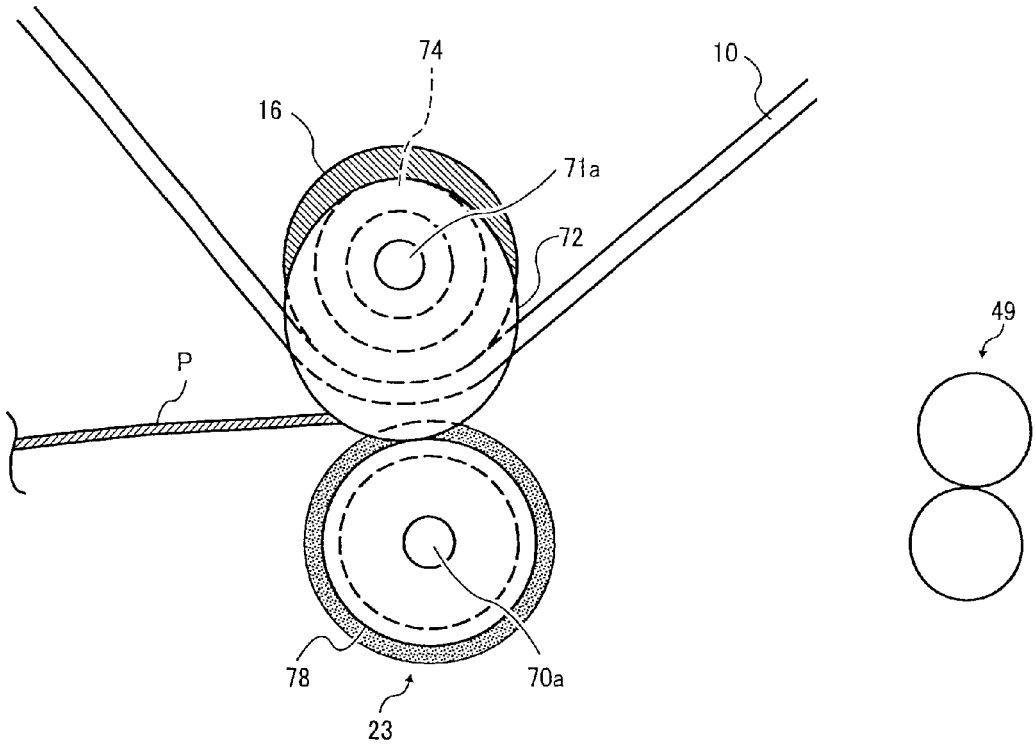
FIG. 16 is a diagram for explaining an operation of the secondary transfer part that is performed immediately before a transfer sheet rear end part is removed from the secondary transfer nip.

Next, an operation of the secondary transfer part that is performed immediately before the transfer sheet is removed from the secondary transfer nip is described with reference to FIG. 16. The drive force transmission means (not shown) of the position regulating cam control means 80 rotates the position regulating cam 72 until a rear end part of the transfer sheet P is removed from the secondary transfer nip part after the transfer of an image rear end part is completed. By the rotation of the position regulating cam 72 and the pressing force of the pressure spring (not shown), the secondary transfer roller 23 is moved and positioned in a position that is away from the intermediate transfer belt 10 with a gap therebetween. As a result, shock generated when the rear end part of the transfer sheet P is removed from the secondary transfer nip part is alleviated, and image quality degradation caused by a fluctuation of the surface movement speed of the intermediate transfer belt 10 can be prevented.

The drive force transmission means (not shown) of the position regulating cam control means 80 rotates the position regulating cam 72 until the next transfer sheet is conveyed to the secondary transfer nip part after the rear end part of the transfer sheet P is removed from the secondary transfer nip part. The position regulating cam 72 separates from the abutting roller 78 as the position regulating cam 72 rotates, and the secondary transfer roller 23 returns to the state where it is pressed against the backup roller 16 by the pressing force of the pressure spring (not shown) via the transfer sheet P and the intermediate transfer belt 10.

By rotating and bringing the position regulating cam 72 into abutment with the abutting roller 78 to alleviate the shock generated when the tip end part of the transfer sheet P enters the secondary transfer nip part, the secondary transfer roller 23 separates from the intermediate transfer belt 10, forming a gap therebetween. While this gap is formed, the transfer current that is induced by the voltage application means 75 flows from the shaft part 71 of the backup roller 16 to the shaft part 70 of the secondary transfer roller 23 through the position regulating cam 72 and the abutting roller 78 that are in abutment with each other. Therefore, leak discharge can be prevented at the gap, and the surface of the intermediate transfer belt 10 can be prevented from being damaged.

In addition, while the image on the intermediate transfer belt 10 is transferred onto the transfer sheet P, the position regulating cam 72 and the abutting roller 78 separate from each other, whereby a sufficient transfer voltage can be obtained and good transfer can be realized. Because the position regulating cam 72 separates from the abutting roller 78, the transfer current flows from the backup roller 16 to the secondary transfer roller 23 via the transfer sheet P and the intermediate transfer belt 10. Consequently, a sufficient transfer electric field can be obtained at the secondary transfer nip part and good transfer can be realized.

Moreover, the total volume resistance value of both the abutting roller 78 and the position regulating cam 72 functioning as gap forming means is set at $1.0\times10^{6}$ to $1.0\times10^{10}$ [$\Omega\cdot cm^{3}$]. Also, it is preferred that the abutting roller 78 and the position regulating cam 72 be formed by a material so that the total volume resistance value of the both becomes substantially equal to the total value of the volume resistances of the secondary transfer roller 23, the intermediate transfer belt 10, and the backup roller 16.

Here, a method for measuring the volume resistance values is as follows. That is, when a direct voltage of 1 KV is applied between the shaft end part 71*a* of the backup roller 16 and the shaft end part 70*a* of the secondary transfer roller 23, the value of current flowing through the abutting roller 78 and position regulating cam 72 functioning as the gap forming means is measured and calculated. In so doing, the backup roller 16 and the secondary transfer roller 23 are separated enough so that the current does not flow from the shaft end part 71*a* of the backup roller 16 to the shaft end part 70*a* of the secondary transfer roller 23 through the backup roller 16, the intermediate transfer belt 10 and the secondary transfer roller 23. Alternatively, the value is measured after performing an insulation process on the backup roller 16 and the secondary transfer roller 23.

When the electric resistances of the gap forming means are excessively low, leak discharge occurs at the gap between the abutting roller 78 and the position regulating cam 72 while the abutting roller and position regulating cam are separated from each other, causing a transfer failure where a sufficient electric field cannot be obtained at the secondary transfer nip part. When the electric resistances of the gap forming means are excessively high, the transfer current does not flow through the gap forming means and consequently does not function as conducting means. As a result, leak discharge might occur at the gap formed between the secondary transfer roller 23 and the intermediate transfer belt 10. Therefore, it is preferred that the electric resistances of the gap forming means fall within the abovementioned range. Further, it is more preferred that the electric resistances be substantially equal to the total value of the volume resistances of the secondary transfer roller 23, the intermediate transfer belt 10 and the backup roller 16.

The electric resistances of the gap forming means may be provided to the abutting roller 78, the position regulating cam 72, the shaft end part 70*a* provided with the abutting roller 78, or the shaft end part 71*a* provided with the position regulating cam 72. Moreover, the electric resistance may be provided to a part or a plurality of sections of gap adjusting means.

In the image forming apparatus of the present embodiment, the present invention has been described above by using a matter that also functions as the conducting means for conducting electricity such that the current induced by the transfer voltage of the transfer voltage application means 75 flows between the intermediate transfer belt 10 and the secondary transfer roller 23 only during a period when the gap forming means separates the intermediate transfer belt 10 from the secondary transfer roller 23 to form a gap therebetween.

However, the present invention is not limited to this configuration, and thus another conducting means may be provided so that the same operational effects can be accomplished.

Moreover, in the image forming apparatus of the present embodiment, the intermediate transfer belt serving as the image carrier is supported by the backup roller 16 and brought into contact with the secondary transfer roller 23 serving as the contact member, whereby the secondary transfer nip is formed. The transfer voltage is applied to the shaft end part 71*a* of the backup roller 16 by the transfer voltage application means 75 to form a transfer electric field. However, the present invention is not limited to this configuration, and the same operational effects can be accomplished by applying the present invention to a configuration where the transfer voltage is applied to the shaft end part 70*a* of the secondary transfer roller by the transfer voltage application means 75 in order to form a transfer electric field. In addition, the image carrier can be applied to not only the intermediate transfer belt 10 but also a drum-like intermediate transfer body and the photosensitive drum. In so doing, the same operational effects can be achieved.

The image forming apparatus of the present embodiment has the following characteristics.

(1) In order to form a transfer electric field for transferring the toner images formed on the intermediate transfer belt 10 to the transfer sheet P, the transfer voltage is applied by the transfer voltage application means 75 at least before the transfer sheet P enters the secondary transfer nip part, whereby a tip end part transfer failure or another form of image degradation can be prevented. In addition, the intermediate transfer belt 10 and the secondary transfer roller 23 are separated to form a gap therebetween by the gap forming means immediately before the entry of the transfer sheet P into the transfer nip part, so that shock generated when the tip end part of the transfer sheet P enters the secondary transfer nip part can be alleviated, and image quality degradation caused by a fluctuation of the surface movement speed of the intermediate transfer belt 10 can be prevented. Moreover, the conducting means for conducting electricity such that the current induced by the transfer voltage flows between the intermediate transfer belt 10 and the secondary transfer roller 23 only during a period when the gap forming means forms a gap. Accordingly, because the current induced by the transfer voltage flows between the intermediate transfer belt 10 and the secondary transfer roller 23 via the conducting means while the gap is formed, the occurrence of leak discharge between the intermediate transfer belt 10 and the secondary transfer roller 23 is prevented. As a result, the intermediate transfer belt 10 is prevented from being damaged by the leak discharge.

(2) By providing the gap forming means with the function of the conducting means, the configuration can be simplified, and cost reduction can be realized.

(3) The gap forming means has the electrically conductive abutting rollers 78 provided to the shaft end part 70*a* of the secondary transfer roller 23, the electrically conductive position regulating cams 72 provided to the shaft end part 71*a* of the backup roller 16 of the intermediate transfer roller 10, and the position regulating cam control means 80. The position regulating cam control means 80 of the gap forming means controls the position of each position regulating cam 72 and brings it into abutment with each abutting roller 78, whereby the abutting roller 78 is moved in the direction where the intermediate transfer belt 10 is separated from the secondary transfer roller 23, so that a gap is formed between the intermediate transfer belt 10 and the secondary transfer roller 23. By performing this operation, the electrically conductive position regulating cam 72 comes into abutment with the electrically conductive abutting roller 78, and the shaft part 71 of the backup roller 16 is electrically conducted with the shaft part 70 of the secondary transfer roller 23 via the position regulating cam 72 and the abutting roller 78, whereby the current induced by the transfer voltage flows between the intermediate transfer belt 10 and the secondary transfer roller 23. With this configuration, the gap forming means that also functions as the conducting means can be embodied easily.

(4) In addition, the position regulating cams 72 can be easily embodied by using the position regulating cams 72 of which position can be controlled in at least two sections.

(5) Furthermore, the image carrier is a belt-like member supported by the backup roller, and the transfer voltage is applied to the shaft part 71 of the backup roller 16 or the secondary transfer roller 23. When using such a belt-like image carrier, significant shock jitter occurs easily when the transfer sheet enters the secondary transfer nip part. Therefore, the effect of the present invention that prevents image degradation such as a tip end part transfer failure has an extensive effect.

(6) The electrical resistances of the gap forming means are preferably a volume electric resistance of $1.0\times10^{6}$ to $1.0\times10^{10}$ [$\Omega\cdot cm^3$]. When the electric resistances of the gap forming means are excessively low, leak discharge occurs at the gap between the abutting roller 78 and the position regulating cam 72 while the abutting roller and position regulating cam are separated from each other, causing a transfer failure where a sufficient electric field cannot be obtained at the secondary transfer nip part. When the electric resistances of the gap forming means are excessively high, the transfer current does not flow through the gap forming means and consequently does not function as the conducting means. As a result, leak discharge might occur at the gap formed between the secondary transfer roller 23 and the intermediate transfer belt 10. Therefore, it is preferred that the electric resistances of the gap forming means fall within the abovementioned range.

(7) In addition, it is preferred that the volume electric resistances of the gap forming mean be substantially equal to the total value of the volume resistances of the secondary transfer roller 23, the intermediate transfer belt 10 and the backup roller 16.

(8) Good transfer characteristics can be obtained by causing the transfer voltage application means to carry out constant current control.

(9) Because the gap forming means separates the intermediate transfer belt 10 and the secondary transfer roller 23 from each other to form a gap therebetween immediately before the transfer sheet is removed from the transfer nip, image degradation caused when the rear end part of the transfer sheet is removed can be prevented.

(10) Moreover, while the toner images on the intermediate transfer belt 10 are being transferred to the transfer sheet, the gap forming means cancel the separation of the intermediate transfer belt 10 from the secondary transfer roller 23, and consequently the secondary transfer roller 23 presses the intermediate transfer belt 10 via the transfer sheet. As a result, a sufficient transfer voltage can be obtained and good transfer can be performed. In addition, because the position regulating cam 72 and the abutting roller 78 are separated from each other, the transfer current flows from the backup roller 16 to the secondary transfer roller 23 via the transfer sheet P and the intermediate transfer belt 10. As a result, a sufficient transfer electric field can be obtained at the secondary transfer nip part and good transfer can be performed.

(11) Recording body information acquisition means for acquiring thickness information of the transfer sheet sent toward the transfer nip is provided. The size of the gap formed by the gap forming means is changed according to the thickness of the recording body that is acquired by the recording body information acquisition means. Therefore, the occurrence of shock jitter can be prevented more effectively.

As described above, according to the second embodiment, in the image forming apparatus in which the recording body is sent into a transfer nip that is formed by the image carrier carrying a toner image and performing surface movement and the contact member contacting with the surface of the image carrier, and the toner image on the image carrier is transferred to the recording medium by the transfer electric field formed in the transfer nip part, image displacement caused upon the entry of the tip end of the recording body into the transfer nip, and image tip end part transfer failure can be prevented without damaging the image carrier. In other words, the image displacement is prevented by forming a gap between the image carrier and the contact member immediately before the recording body enters the transfer nip part. Furthermore, by starting to apply the transfer voltage from the transfer voltage application means before the recording body enters the transfer nip part, the image tip end part transfer failure is prevented. Even when the transfer voltage is applied while the gap is formed between the separated image carrier and contact member, the current induced by the transfer voltage flows between the image carrier and the contact member through the conducting means. Hence, leak discharge does not occur at the gap between the image carrier and the contact member. Consequently, the image carrier can be prevented from being damaged by the leak discharge.

Various modifications will become possible for those skilled in the art after receiving the teachings of the present disclosure without departing from the scope thereof.

What is claimed is:

1. An image forming apparatus, comprising:

an image carrier that carries a toner image and performs surface movement;

a contact member that comes into contact with the image carrier while performing surface movement and forms a transfer nip;

recording body sending means for sending a recording body toward the transfer nip;

transfer voltage application means for starting to apply transfer voltage to the image carrier or the contact member prior to the entry of the recording body into the transfer nip, so as to form a transfer electric field for transferring the toner image on the image carrier to the recording body; and gap forming means for separating the image carrier and the contact member from each other to form a gap therebetween immediately before the recording body enters the transfer nip part, the image forming apparatus further comprising conducting means for conducting electricity so that current induced by the transfer voltage applied by the transfer voltage application means flows between the image carrier and the contact member while the gap forming means separates the image carrier and the contact member from each other to form a gap therebetween.

2. The image forming apparatus as claimed in claim 1, wherein the gap forming means has a function of the conducting means.

3. The image forming apparatus as claimed in claim 2, wherein the gap forming means has an electrically conductive abutting member that is provided to either a rotation central shaft for causing the image carrier to perform surface movement or a rotation central shaft for causing the contact member to perform surface movement in the transfer nip, an electrically conductive position regulating member provided to the other rotation central shaft, and position regulating member control means for controlling the position of the position regulating member, and wherein the position regulating member control means controls the position of the position regulating member to bring the position regulating member into abutment with the abutting member, whereby the abutting member is moved in a direction where the image carrier and the contact member are separated from each other, to form a gap between the image carrier and the contact member, and the rotation central shaft of the image carrier is electrically conducted with the rotation central shaft of the contact member via the abutting member and the position regulating member.

4. The image forming apparatus as claimed in claim 3, wherein the position regulating member is an eccentric cam of which position can be controlled in at least two sections.

5. The image forming apparatus as claimed in claim 1, wherein the image carrier is in the form of a belt, the image forming apparatus has a backup roller for supporting a belt so that the image carrier and the contact member forms the transfer nip, and the transfer voltage is applied to a rotation central shaft of the backup roller or the contact member by the transfer voltage application means.

6. The image forming apparatus as claimed in claim 5, wherein the conducting means has a volume electric resistance substantially equal to a total value of volume electric resistances of the contact member, the image carrier and the backup roller.

7. The image forming apparatus as claimed in claim 1, wherein the conducting means has a volume electric resistance of $1.0\times10^{6}$ to $1.0\times10^{10}$ [$\Omega\cdot cm^{3}$].

8. The image forming apparatus as claimed in claim 1, wherein the transfer voltage application means carries out constant current control.

9. The image forming apparatus as claimed in claim 1, wherein the gap forming means separates the image carrier and the contact member from each other to form a gap therebetween immediately before the recording body is removed from the transfer nip.

10. The image forming apparatus as claimed in claim 1, wherein the gap forming member cancels the separation of the image carrier from the contact member while the toner image on the image carrier is being transferred onto the recording body, and the contact member presses the image carrier via the recording body.

11. The image forming apparatus as claimed in claim 1, further comprising recording body information acquisition means for acquiring thickness information of the recording body that is sent toward the transfer nip by the recording body sending means, wherein the size of the gap formed by the gap forming means is changed according to the thickness of the recording body that is acquired by the recording information acquisition means.

* * * * *